US009481955B2

(12) United States Patent
Evans et al.

(10) Patent No.: US 9,481,955 B2
(45) Date of Patent: Nov. 1, 2016

(54) STITCHING SYSTEM WITH REAL-TIME STEERING CONTROL

(71) Applicant: Johnson Controls Technology Company, Holland, MI (US)

(72) Inventors: Gregg S. Evans, Stratford (CA); Jeff A. Sawyer, London (CA)

( * ) Notice: Subject to any disclaimer, the term of this patent is extended or adjusted under 35 U.S.C. 154(b) by 591 days.

(21) Appl. No.: 13/957,061

(22) Filed: Aug. 1, 2013

(65) Prior Publication Data

US 2014/0033960 A1 Feb. 6, 2014

Related U.S. Application Data

(60) Provisional application No. 61/678,907, filed on Aug. 2, 2012, provisional application No. 61/792,133, filed on Mar. 15, 2013.

(51) Int. Cl.
*D05B 19/12* (2006.01)
*D05B 75/02* (2006.01)

(52) U.S. Cl.
CPC ..... *D05B 19/12* (2013.01); *D05B 75/02* (2013.01)

(58) Field of Classification Search
CPC .... D05B 35/10; D05B 35/102; D05B 73/12; D05B 27/02; D05B 75/02; D05B 69/20; D05B 2207/04; D05B 59/02; D05B 33/00; G05B 13/042; G05B 13/048
See application file for complete search history.

(56) References Cited

U.S. PATENT DOCUMENTS 3,080,836 A 3/1963 Clemens et al.
3,417,718 A 12/1968 Andersson
3,472,187 A 10/1969 Kaplan et al.
4,019,447 A 4/1977 Blessing et al.
4,248,170 A 2/1981 Adamski, Jr. et al.
4,682,553 A 7/1987 Bachmann et al.
4,683,827 A * 8/1987 Kinoshita ..... D05B 19/12 112/453
4,834,008 A 5/1989 Sadeh et al.
4,899,287 A 2/1990 Hulshoff et al.

(Continued)

FOREIGN PATENT DOCUMENTS

EP 0194182 B1 9/1989

OTHER PUBLICATIONS

Keilmann Group, Datasheet, KL 500 Robotic Sewing Unit [online] [retrieved on Mar. 13, 2014]. Retrieved from the internet: <URL: http://www.ksl-lorsch.de/fileadmin/user_upload/Produkte/Basic_3D-Roboter-Naehanlage_KL_500/Datasheet_KL_500_Dashboard.pdf>.

Durkopp Adler, Products, 550-867—Engineered Sewing Station for Documented Airbag Tearing Seams [online] [retrieved on Mar. 13, 2014] Retrieved from the internet: <URL: http://www.duerkopp-adler.com/en/main/products/MS_11_engineered/550-867.html>.

(Continued)

*Primary Examiner* — Danny Worrell

(57) ABSTRACT

A stitching system is configured to stitch through decorative skins with a molded seam recess representing a seam and includes a sewing machine, an image acquisition mechanism, a controller, and a rotation mechanism. The sewing machine is rotatable with respect to a support table, and includes a sewing head to receive a sewing needle and a sewing foot to selectively engage the skin. The image acquisition mechanism produces an image of the seam recess with respect to the sewing head/needle(s). The controller determines the difference between the actual recess location and a predetermined desired recess location. Based on this difference, the controller determines a sewing machine rotation angle and orientation to reduce the difference to zero, and then produces a corresponding adjustment signal that drives the rotation mechanism. A robot can move either the sewing machine or the workpiece, and still use the herein-described real time steering control.

30 Claims, 12 Drawing Sheets

(56) References Cited

U.S. PATENT DOCUMENTS

| | | | | |
|---|---|---|---|---|
| 5,293,828 | A * | 3/1994 | Nishizawa | D05B 69/18 112/277 |
| 5,372,078 | A * | 12/1994 | Hoshina | D05B 19/16 112/102.5 |
| 5,427,040 | A | 6/1995 | Abe et al. | |
| 7,689,309 | B2 | 3/2010 | Zheng | |

OTHER PUBLICATIONS

Durkopp Adler, Downloads for 550-867, Configuring the Scanner 9835400011, Part No. 0791 550668 [online] [retrieved on Mar. 13, 2014] Retrieved from the internet: <URL: http://www.duerkopp-adler.com/export/sites/duerkoppadler/commons/download/public/550-867/0791_550668.pdf>.

Durkopp Adler, Downloads for 550-867, Fitting Instructions Edge Recogniation Kit 0867590944, Part. No. 0791 550702 [online] [retrieved on Mar. 13, 2014] Retrieved from the internet: <URL: http:www.duerkopp-adler.com/export/sites/duerkoppadler/commons/download/public/550-867/0791_550702.pdf>.

Durkopp Adler, Downloads for 550-867, Leaflet Feb. 2011 [online] [retrieved on Mar. 13, 2014] Retrieved from the internet: <URL: http://www.duerkopp-adler.com/export/sites/duerkoppadler/commons/download/public/550-867/550-867_de_en_fr.pdf>.

Durkopp Adler, Downloads for 550-867,M-Type 550-867 Operating Instructions [online] [retrieved on Mar. 13, 2014] Retrieved from the internet: <URL: http://www.duerkopp-adler.com/export/sites/duerkoppadler/commons/download/public/550-867/b_550-867_en.pdf>.

Durkopp Adler, Downloads for 550-867,M-Type 550-867 Parts List and Sewing Equipment [online] [retrieved on Mar. 13, 2014] Retrieved from the internet: <URL: http://www.duerkopp-adler.com/export/sites/duerkoppadler/commons/download/public/550-867/550-867.pdf>.

Durkopp Adler, Downloads for 550-867,M-Type 550-867 Service Instructions [online] [retrieved on Mar. 13, 2014] Retrieved from the internet: <http://www/duerkopp-adler.com/export/sites/duerkoppadler/commons/download/public/550-867/s_550-867_en.pdf>.

Durkopp Adler, Dowloads for 550-867, M-Type 550-867, Upgrade Manual BTSR Sensor [online] [retrieved on Apr. 4, 2014] Retrieved from the internet: <http://www.duerkopp-adler.com/export/sites/duerkoppadler/commons/download/public/550-867/0791_550662_EN.pdf>.

Durkopp Adler, Products, 911-210-3020—CNC-Controlled Pattern Stitcher for Medium-Heavy Duty Applications [online] [retrieved on Mar. 14, 2014] Retrieved from the intenet: <http://www.duerkopp-adler.com/en/main/products/MS_12_sewing_units/911-210-3020.html>.

Durkopp Adler, Downloads for 911, Fitting Instruction for the Kit Reduced Pressure—0911 597544, Part-No. 0791911700 [online] [retrieved on Mar. 14, 2014] Retrieved from the internet: <URL: http://www.duerkopp-adler.com/export/sites/duerkoppadler/commons/download/public/911/0791_911700-M.pdf>.

Durkopp Adler, Downloads for 911, Fitting Instruction for Laser Lamp Kit 0911 597524, Part-No. 0791 911701 [online] [retrieved on Mar. 14, 2014] Retrieved from the internet: <URL: http://www.duerkopp-adler.com/export/sites/duerkoppadler/commons/download/public/911/0791_911701-M.pdf>.

Durkopp Adler, Downloads for 911, Fitting Instructions Barcode Reader Kit 0911 597554, Part-No. 0791 911702 [online] [retrieved on Mar. 14, 2014] Retrieved from the internet: <URL: http://www.duerkoff-adler.com/export/sites/duerkoppadler/commons/download/public/911/0791_911702-M.pdf>.

Durkopp Adler, Downloads for 911, Fitting Instruction for Remaining Thread Monitor Kit 0911 597754, Part-No. 0791 911703 [online] [retrieved on Mar. 14, 2014] Retrieved from the internet: <URL: http://www.duerkopp-adler.com/export/sites/duerkoppadler/commons/download/public/911/0791_911703-M.pdf>.

Durkopp Adler, Downloads for 911, CNC-Controlled Sewing Unit with Large Sewing Area—Installation Instructions [online] [retrieved on Mar. 14, 2014] Retrieved from the internet: <URL: http://www.duerkopp-adler.com/export/sites/duerkoppadler/commons/download/public/911/a_911_gb.pdf>.

Durkopp Adler, Downloads for 911, Leaflet, Oct. 2010, 911-210, CNC-Controlled Pattern Stitcher for Medium-Heavy Duty Applications [online] [retrieved on Mar. 14, 2014] Retrieved from the internet: <URL: http://www.duerkopp-adler.com/export/sites/duerkoppadler/commons/download/public/911/911-210_de_en_fr.pdf>.

Durkopp Adler, Downloads for 911, Leaflet, Feb. 2014, 911-210, CNC-Controlled Pattern Sticher for Medium-Heavy Duty Applications [online] [retrieved on Mar. 14, 2013] Retrieved from the internet: <URL: http://www.duerkopp-adler.com/export/sites/duerkoppadler/commons/download/public/911/da_911-210_deen_02-2014.pdf>.

Durkopp Adler, Downloads for 911, CNC-Controlled Sewing Unit with Large Sewing Area—Operating Instructions [online] [retrieved on Mar. 14, 2014] Retrieved from the internet: <URL: http://www.duerkopp-adler.com/export/sites/duerkoppadler/commons/download/public/911/b_911_gb.pdf>.

Durkopp Adler, Downloads for 911, Parts List and Sewing Equipment [online] [retrieved on Mar. 14, 2014] Retrieved from the internet: <URL: http://www.duerkopp-adler.com/export/sites/duerkoppadler/commons/download/public/911/911.pdf>.

Durkopp Adler, Downloads for 911, CNC-Controlled Sewing Unit with Large Sewing Area—Service instructions [online] [retrieved on Mar. 14, 2014] Retrieved from the intenet: <URL: http:http://www.duerkoff-adler.com/export/sites/duerkoppadler/commons/download/public/911/s_911_gb.pdf>.

Durkopp Adler, Downloads for 911, Additional Instructions—Stitch Position Optimization [online] [retrieved on May 13, 2014] Retrieved from the internet: <URL: http://www.duerkoff-adler.com/export/sites/duerkoppadler/commons/download/public/911/0791_911682_EN.pdf>.

Eisenberg, For the Home Workshop, a GPS for Power Tools, The New York Times, Sep. 22, 2012 [online] [retrieved on Aug. 22, 2012]. Retrieved from the internet: <URL: http://www.nytimes.com/2012/09/23/technology/computer-precision-for-power-tools-novelties.html>.

Durkopp Adler, The New Generation, 2005, published by Durkopp Adler AG [online] [retrieved on Aug. 5, 2014] Retrieved from the internet: <URL: http://www.duerkopp-adler.com/export/sites/duerkoppadler/commons/applications/downloads/M-TYPE_1104_2.pdf>.

Durkopp Adler, Sewing Technology for Interior Decoration, Apr. 2008, published by Durkopp Adler AG [online] [retrieved on Aug. 5, 2014] Retrieved from the internet: <URL: http://www.duerkopp-adler.com/export/sites/ duerkoppadler/commons/download/technology_praxis/DA_Interior_Decoration_EN_Preview.pdf>.

Durkopp Adler, World of Sewing Technology—Industrial 2009, Apr. 2009 [online] [retrieved on Aug. 5, 2014] Retrieved fromthe internet: <URL: http://www.duerkopp-adler.com/export/sites/duerkoppadler/commons/download/download-text-attachments/IMB_industrial_300309.pdf>.

Office Action from the United States Patent and Trademark Office for U.S. Appl. No. 13/956,986 dated Jan. 14, 2015 (5 pages).

Durkopp Adler, Application Center, Decorative Seams in Automotive Interior [online] [retrieved on Jul. 16, 2014]. Retrieved from the internet: <URL: http://www.duerkopp-adler.com/export/sites/duerkoppadler/commons/download/APC_Flyer/APC_Flyer_204-0121_EN_04-08.pdf>.

Durkopp Adler, Application Center, Sewing Bed Ticking—With Consistently High Seam Quality [online] [retrieved on Jul. 16, 2014] Retrieved from the internet: <URL: http://www.duerkopp-adler.com/export/sites/duerkoppadler/commons/ download/APC_Flyer/APC_Flyer_827-0121_EN_04-08.pdf>.

* cited by examiner

| | | COEFFICIENTS | | |
|---|---|---|---|---|
| | SEGMENT | P | I | D |
| $90_1$ | 1 | $P_1$ | $I_1$ | $D_1$ |
| $90_2$ | 2 | $P_2$ | $I_2$ | $D_2$ |
| $90_3$ | 3 | $P_3$ | $I_3$ | $D_3$ |
| ⋮ | ⋮ | ⋮ | ⋮ | ⋮ |
| $90_n$ | n | $P_n$ | $I_n$ | $D_n$ |

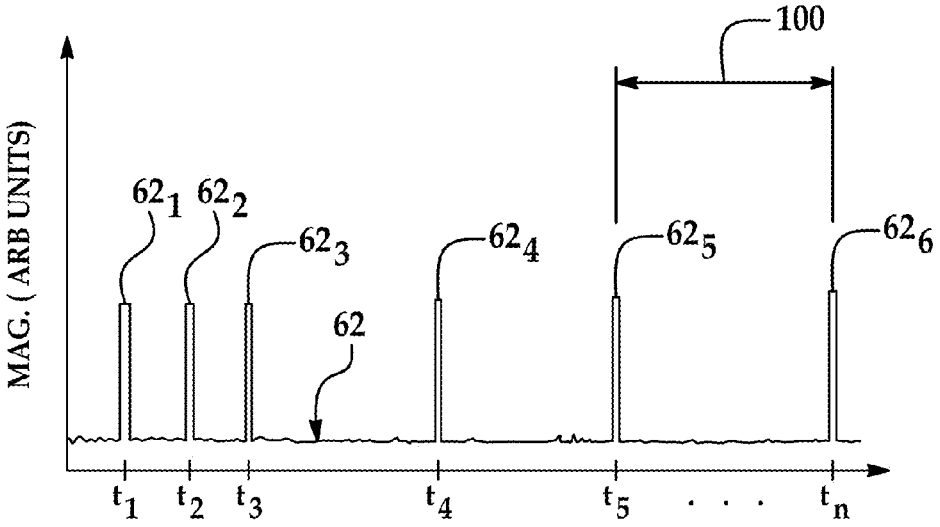
FIG. 11
| | STITCH NUMBER | COMPENSATION AMOUNT | |
|---|---|---|---|
| $102_1$ | 1 | $C_1$ | $104_1$ |
| $102_2$ | 2 | $C_2$ | $104_2$ |
| $102_3$ | 3 | $C_3$ | $104_3$ |
| ⋮ | ⋮ | ⋮ | |
| $102_n$ | n | $C_n$ | $104_n$ |
FIG. 12
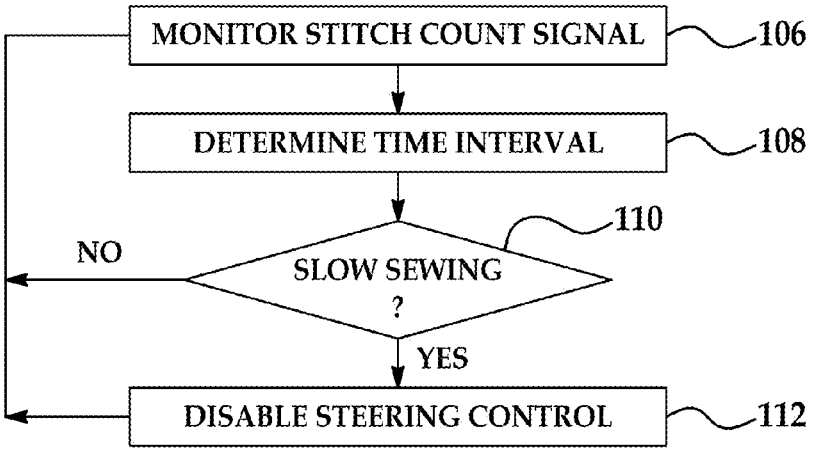
FIG. 13

STITCHING SYSTEM WITH REAL-TIME STEERING CONTROL

CROSS-REFERENCE TO RELATED APPLICATIONS

This application claims the benefit of U.S. provisional application No. 61/678,907, filed 2 Aug. 2012 (the '907 application), and U.S. provisional application No. 61/792,133 filed 15 Mar. 2013 (the '133 application). The '907 application and the '133 application are both hereby incorporated by reference as though fully set forth herein.

BACKGROUND a. Technical Field

This instant disclosure relates generally to the sewing of formed, plastic skins with recesses representing seams and, more particularly, to a system for decorative stitching of the skins.

b. Background Art

This background description is set forth below for the purpose of providing context only. Therefore, any aspects of this background description, to the extent that it does not otherwise qualify as prior art, is neither expressly nor impliedly admitted as prior art against the instant disclosure.

Automotive interior components are produced to a variety of specifications based upon the quality and fit expected by customers. For automotive instrument panels and other formed, plastic skins with recesses representing seams, a hand-crafted stitched appearance with a contrasting thread color is generally indicative of a high-quality product, whereas a molded stitch-like feature is seen as an imitation and, thus, a lower-quality product. Therefore, for automotive instrument panels and other such components, a stitched appearance is generally desirable over an otherwise molded stitch-like feature appearance for imparting the look and feel of a high-quality product, even if the displayed stitches appear to join the various sections of different components but actually are provided for decorative purposes only.

The location tolerances associated with decorative stitching are very tight and can be as small as one half of a millimeter. Therefore, it is difficult for the operator to sew within these tolerances with just his or her own eyes. Automated sewing machines generally allow for faster processing; however, automated sewing machines cannot maneuver the skin adequately, particularly where there are sharp angles or other complex geometries in the stitching.

The foregoing discussion is intended only to illustrate the present field and should not be taken as a disavowal of claim scope.

BRIEF SUMMARY

In an embodiment, a stitching system is provided that is configured to stitch through an automotive interior skin with a molded seam recess between generally exposed top and bottom surfaces thereof. The system includes a sewing machine, a sensor, an electronic controller, and a rotation mechanism. The sewing machine is disposed proximate a stationary support table and includes a sewing head with a sewing foot and a sewing needle receiver for receiving a needle. The sewing machine may be rotatably coupled to a pivoting base wherein rotation of the sewing machine rotates at least the sewing head and the sewing foot about a swivel axis that is generally parallel to a needle axis through the sewing needle. The swivel axis may be offset from the needle axis. The sensor may be located in sensing proximity to the sewing head and may be configured to produce an output indicative of an actual location of the recess in the skin. The electronic controller includes an electronic processor that is configured to determine a difference between the actual location of the recess and a predetermined, desired location of the recess based on the sensor output. The controller is further configured to determine a rotation angle and orientation for the sewing machine that is configured to reduce a magnitude of such difference. The controller is further configured to produce an adjustment signal indicative of the determined (desired) rotation angle and orientation for the sewing machine. The rotation mechanism is responsive to the adjustment signal and is configured to rotate the sewing machine in the determined rotation orientation (e.g., clockwise or counter-clockwise) to the determined rotation angle.

In other embodiments, various apparatus and methods are also presented.

The foregoing and other aspects, features, details, utilities, and advantages of the present disclosure will be apparent from reading the following description and claims, and from reviewing the accompanying drawings.

BRIEF DESCRIPTION OF THE DRAWINGS

FIG. 11 is a timing diagram view of a stitch counter output signal over time.

FIG. 12 is a table showing exemplary stitch number-versus-compensation amounts for adjusting the output of the control logic of FIG. 6.

FIG. 13 is a flowchart showing, in an embodiment, a method for disabling steering control.

DETAILED DESCRIPTION

As described in the Background, the tolerances associated with the decorative stitching of automotive interior parts are very tight and can be as small as plus or minus one half of a millimeter. It is very difficult for an operator to stay within these tight tolerances using just his or her own sight. Moreover, the curves and complex geometries of the decorative stitching make total automation difficult. Due to the large number of calculations associated therewith, a fully automated sewing machine may be relatively slow. Thus, there is a need for an efficient decorative stitching system that allows (1) the use of the dexterity of the operator in manipulating the parts through complex geometries while allowing (2) the automated capabilities of a control system to remain within the tight tolerances. One object of the instant disclosure is thus to provide a decorative stitching system that quickly sews within the tight tolerances associated with decorative automotive stitching but that allows the operator to maneuver the skin through complex geometries and other demanding situations, where needed.

Figure 1A:
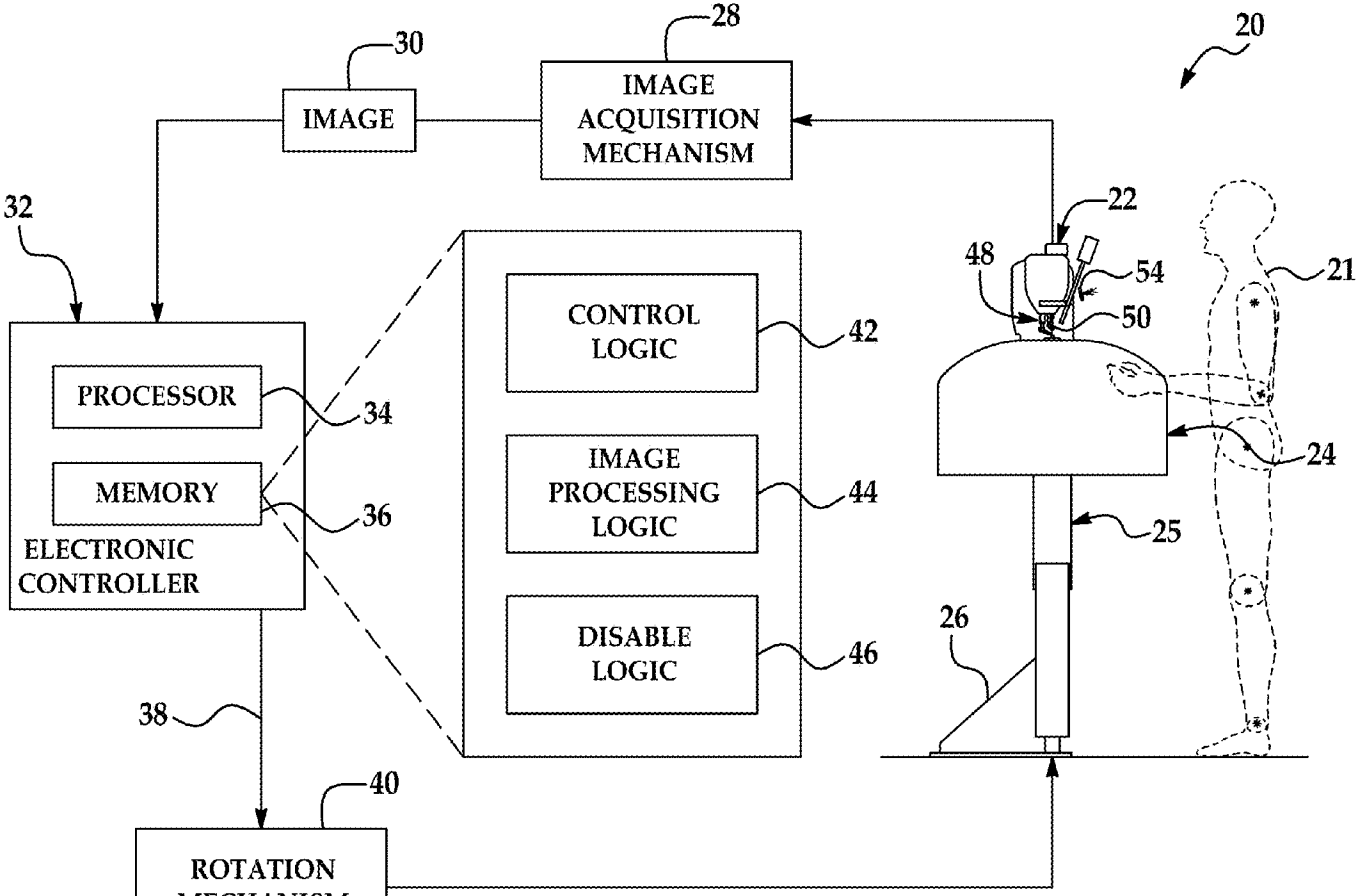
FIG. 1A is a diagrammatic and block diagram view of an embodiment of a stitching system with steering control.

Referring now to the drawings wherein like reference numerals are used to identify identical or similar components in the various views, FIG. 1A is a diagrammatic and block diagram view of a stitching system 20, which may be used, in an embodiment, for decorative stitching applications. The stitching system 20 includes a steering control feature based on real-time feedback as to the actual position of the sewing machine relative to the work-piece to be stitched. In the illustrative embodiment, the work-piece may include an automotive interior skin of the type having a molded seam recess, and which may have generally exposed top and bottom surfaces. In an embodiment, the stitching system 20 may be configured with two needles to produce a so-called French seam about the molded seam recess. The system 20 is configured to correct misalignment up to a predetermined amount between the actual travel line of the seam on the work-piece (relative to the sewing head) and the desired feed line for the seam needed to achieve predefined stitch placement requirements within tolerance expectations. In other words, the operator 21 need only maneuver the work-piece (skin) so that the molded seam recess is "close" to the desired feed line (i.e., within the correction capabilities of the steering control), and then the real-time steering control of the stitching system 20 makes any necessary adjustments.

The stitching system 20 includes a sewing machine 22 disposed in a location next to a stationary support table 24. In the illustrated embodiment, the sewing machine 22 is rotatably coupled to a pivoting base 25 such that the sewing machine 22 can be pivoted through a certain range in order to implement the real-time steering control described below. The stitching system 20 also includes a sensor, for example, in the form of an image acquisition mechanism 28 configured to produce an image 30, an electronic controller 32 (including one or more electronic processors 34 and memory 36) that is configured to generate an adjustment signal 38, and a rotation mechanism 40. FIG. 1 also shows a display 54.

Figure 3A:
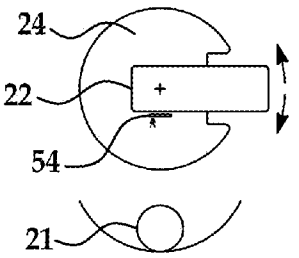
FIGS. 3A-3C are diagrammatic, top views of the sewing machine portion of FIG. 1A showing a pivoting embodiment of steering control.
Figure 3B:
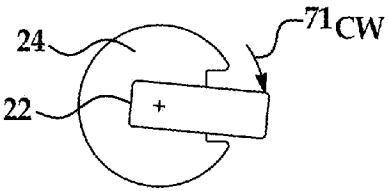
Figure 3C:
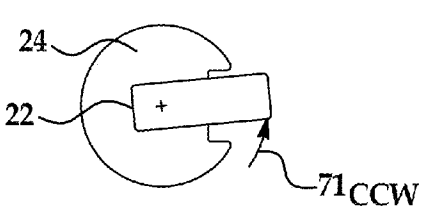
Figure 3D:
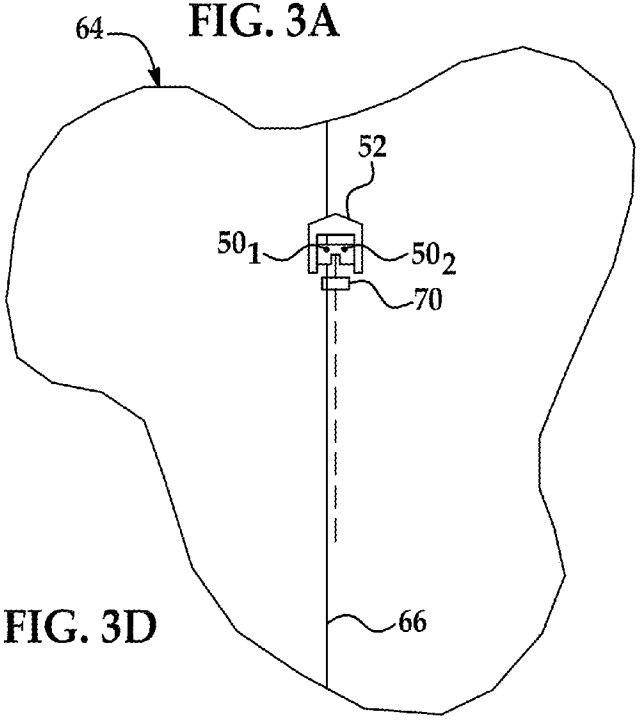
FIG. 3D is a diagrammatic, top view of the sewing machine of FIG. 1A in relation to a skin to be stitched, wherein the sewing needles and the sewing foot of FIG. 1B are in a home position, and wherein a seam recess in the skin, about which stitch lines are to be placed, is offset to the left.
Figure 3E:
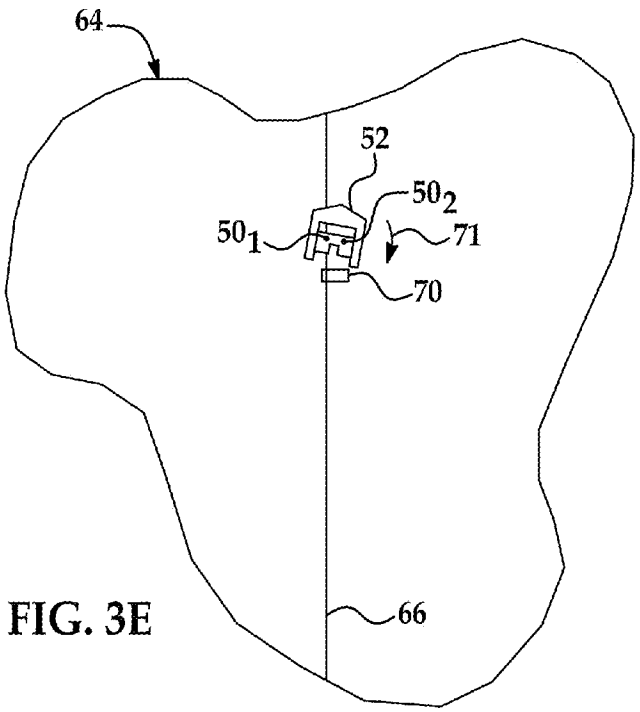
FIG. 3E is a diagrammatic, top view of the sewing machine of FIG. 3D that has been rotated clockwise to correct for the misalignment shown in FIG. 3D.

The sewing machine 22 is configured to stitch an automotive interior skin 64 (best shown in FIGS. 3D-3E). The sewing machine 22 includes a sewing head 48 that includes one or more sewing needle receivers configured to receive and retain a respective sewing needle 50 as well as a sewing foot 52, best shown in FIG. 1B. The sewing machine 22 is positioned relative to the support table 24 so that rotation of the sewing machine 22 will result in a rotation of the sewing head 48 and the sewing foot 52. The sewing machine 22 may comprise conventional components known in the art, for example only, components known under the trade designation M-type series, commercially available from Dürkopp Adler AG, Bielefeld, Germany.

The support table 24, in an embodiment, is stationary relative to the operator 21 and the sewing machine 24. The table 24 is configured to support the skin 64 as it is fed to the sewing machine 64. For example, the table 24 may be shaped like a dome so that the operator 21 can drape the skin 64 over the table and rotate the skin 64 as needed in order to maneuver the skin toward the sewing head 48. Because of the convex shape of the support surface of the table 24, the operator 21 may conform his palms to the shape of the dome and, thus, better manipulate the automotive interior skin 64. The support table 24 may, however, in other embodiments, be flat or take on some other shape. In an embodiment, the support surface of table 24 may be coated with a low-friction material, such as a commercially available material sold under the trade designation TEFLON®. Sewing machine 22 may not be physically coupled to the stationary support table 24 but, instead, be free-standing with respect to the table 24.

The image acquisition mechanism 28 is disposed, generally, is visual sensing proximity to the feed-side of the sewing head 48, and produces an output thereof, namely, image 30. The image 30 indicates a real-time position of the automotive interior skin 64 in the area that is being fed into the sewing head 48 for stitching. In other words, the image acquisition mechanism 28 generates the image 30 based on a view of a region in front of (i.e., in-feed side) the needle-strike area of the sewing machine 22. The image 30 can be processed in order to determine the actual location of the seam recess in the skin 64.

The electronic controller 32 is configured to output an adjustment signal 38, which can be used to control the rotation of the rotation mechanism 40. The electronic controller 32 is configured generally to process information indicative of whether and to what extent the recess 66 in the skin 64 is offset from the desired feed path. As described in greater detail below, in an embodiment, the electronic controller 32 is configured to receive and process image 30 to determine the above-mentioned offset information. The electronic controller 32 may include one or more processors 34 and memory 36. The one or more processors 34 may comprise conventional components known in the art. Memory 36 is provided for storage of data and instructions or code (i.e., software) for access and/or execution by the one or more processors 34. Memory 36 may include various forms of non-volatile (i.e., non-transitory) memory and/or volatile memory.

The electronic controller 32 may include one or more application programs stored in memory 36 and configured for execution by the one or more processors 34. FIG. 1 shows, for example, control logic 42, image processing logic 44, and disable logic 46, all of which are stored in memory 36 and configured for execution by the one or more processors 34.

Image processing logic 44 is configured to determine, in an image-processing based embodiment, a difference between an actual location of the recess 66 in the automotive interior skin 64 and a predetermined desired location for the recess 66. This difference may be viewed as an "error" signal or the amount that the skin 64 is misaligned relative the desired in-feed travel path.

Control logic 42 is configured to determine a rotation angle and orientation indicative of how much and in what direction (i.e., clockwise or counter-clockwise), respectively, to rotate the sewing machine 22, if at all, to correct for the above-described in-feed misalignment. In a servo-based embodiment (FIGS. 14-15), the control logic 42 generates the adjustment signal 38, which indicates the magnitude of the desired corrective rotation angle (i.e., in degrees) as well as a direction 71 (best shown in FIGS. 3B-3E), suitable for application to a servo-drive. However, in other embodiments, the form of adjustment signal 38 may be modified so as to be compatible with the destination movement mechanism.

In an embodiment, control logic 42 may implement a proportional-integral-derivative (PID) feedback control strategy that is responsive to the determined difference between the actual recess location and the desired recess location. It should be understood that other control schemes may be used and remain within the spirit and scope of this disclosure. The magnitude of rotational authority allocated to the control logic 42 may be between about +5 degrees. Of course, this is exemplary only and not limiting in nature.

Disable logic 46 is configured to determine whether the sewing speed is slow enough such that automatic rotational control (i.e., steering control) of the stitching system 20 should be disabled (e.g., during sewing through complex geometries where it may be desirable for the operator 21 to operate the sewing machine 22). In other words, when sewing speeds fall below a predetermined threshold, the disable logic 46 assumes that the operator 21 wishes to manually operate the sewing machine 22 without the steering assistance from the stitching system 20. In such a scenario, in an embodiment, the adjustment signal 38 may be set to zero, which places the sewing machine 22, and thus the sewing head 48, to a home position.

The rotation mechanism 40 is configured to receive the adjustment signal 38 that specifies the commanded rotation angle (magnitude) and orientation (CW or CCW) and to rotate the pivoting base 25 accordingly. The pivoting base 25 may be mechanically coupled to the sewing machine 22 such that the rotation of the pivoting base 25 also results in a corresponding rotation of the sewing machine 22. As shown in FIG. 1, in an embodiment, a lever arm 26 may be coupled with the mechanism 40 for applying a rotational force to the pivoting base 25 (alternatively, a gear box driven by a servo motor).

Figure 1B:
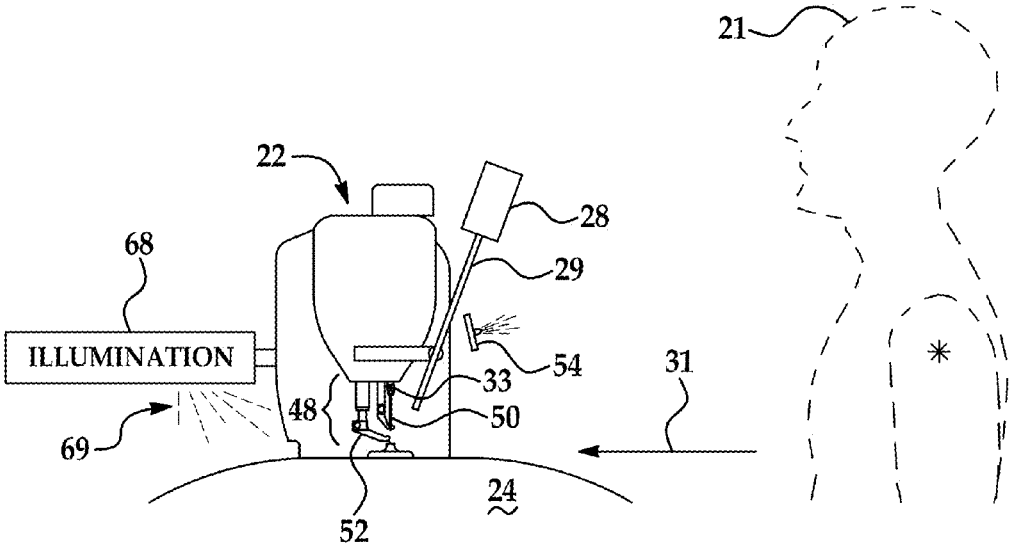
FIG. 1B is a diagrammatic view showing, in greater detail, the sewing machine portion of FIG. 1A, as viewed from the side with respect to the direction of the movement of the skin.

FIG. 1B shows, in greater detail, the sewing machine 22 of FIG. 1A. The image acquisition system 28 may include a vision camera 28 or the like coupled to a bore-scope 29. The distal end of the bore-scope is configured to acquire an image of the in-feed side of the sewing machine 22. In this regard, the automotive interior skin 64 (not shown) is maneuvered or otherwise fed in the general direction 31. The sewing head 48 includes a sewing needle receiver 33 and a sewing foot 52. FIG. 1B also shows display 54, which is configured to emit light signals discernible by operator 21, and configured to communicate where the pivoting base 25 is within its control window as the operator is now only required to keep the skin feeding within the +/−5 degree range that the pivoting base 25 can compensate within. FIG. 1B also shows an illumination source 68 disposed with respect to the sewing machine 22 so as to project oblique illumination 69 on the automotive interior skin 64 (not shown in FIG. 1B) to cast a shadow on the seam recess 66 (best shown in FIG. 4).

Figure 1C:
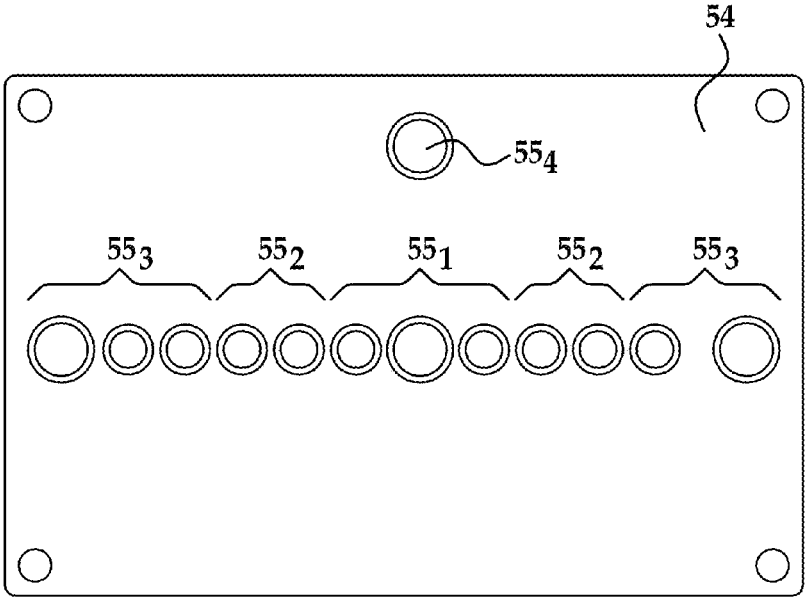
FIG. 1C is a diagrammatic view showing, in greater detail, the display in FIG. 1B.

FIG. 1C is a diagrammatic view showing, in greater detail, the display 54 of FIG. 1A. The display 54 is positioned near or proximate of the sewing machine 22 and positioned so as to be easily visible to the operator 21. The display 54 is electrically coupled to the controller 32, which controls the display 54 as described below. The main function of display 54 is to signal to the operator whether the automotive interior skin 64 is being positioned "close enough" to the desired feed path that the steering control of system 20 can fully adjust to keep the finished stitching positioning within a predetermined tolerance.

In this regard, the controller 32 may be configured to control the display 54 so as to emit a first light signal $55_1$ when the difference described above between the actual seam recess location and the desired seam recess location (the misalignment) is less than a first predetermined threshold. The controller 32 is further configured to control the display 54 so as to emit a second light signal $55_2$ when the misalignment exceeds the first threshold mentioned above but is less than a second predetermined threshold that is greater than the first threshold. The controller 32 is further configured to control the display 54 so as to emit a third light signal $55_3$ when the misalignment exceeds the second threshold, which is higher than the second threshold. In an embodiment, the first, second and third light signals may constitute GREEN (e.g., within tolerance), YELLOW (e.g., within tolerance, but nearly exceed the maximum tolerance), and RED (e.g., out of tolerance) lights. Overall, the series of light signals corresponds to a physical window that straddles the seam recess, and which therefore informs the operator 21 where the stitching line(s) stand within the window.

The controller 32 may be still further configured to control the display 54 so as to emit a queuing light signal $55_4$. The queuing light signal $55_4$ warns the operator (e.g., through flashing) just prior to when a curvature radius of the seam recess is expected to change suddenly (e.g., and significantly—increase or decrease beyond a predetermined threshold). This warning allows the operator 21 to prepare for such a change in curvature.

Figure 2:
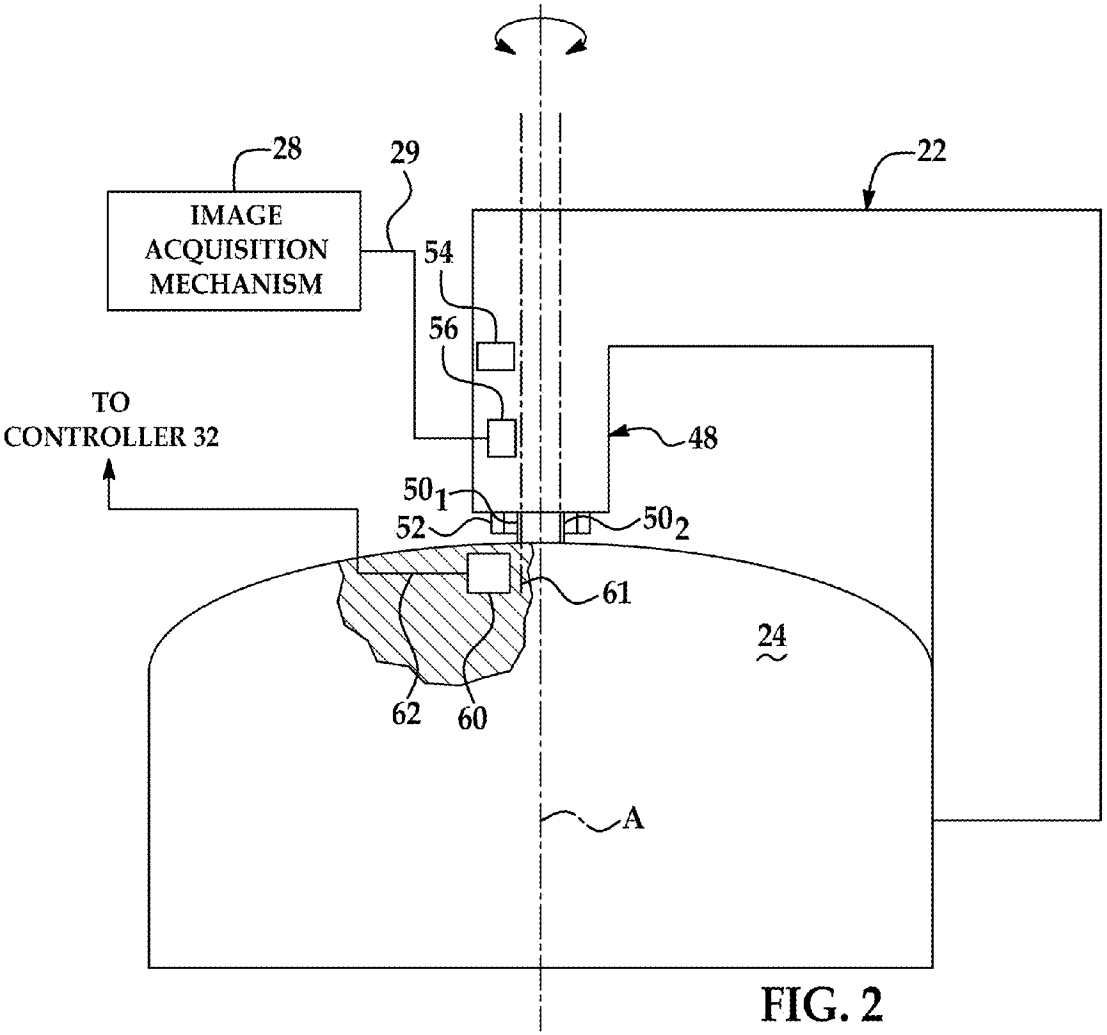
FIG. 2 is a diagrammatic view showing, in greater detail, the sewing machine portion of FIG. 1A, as viewed in the direction of the movement of the skin.

FIG. 2 is a diagrammatic view of the sewing machine 22 in relation to the stationary support table 24. In the illustrated embodiment, the sewing head 48 includes the sewing foot 52 and a plurality of sewing needle receivers containing sewing needles designated $50_1$, $50_2$. Sewing foot 52 is configured to selectively engage automotive interior skin 64 so that automotive interior skin 64 remains flat while the sewing needles $50_1$, $50_2$ go through the skin 64 from the top to the bottom surfaces. To correct for misalignment, the sewing machine 22 generally rotates about a swivel axis "A". The swivel axis "A" may be generally parallel to and offset a predetermined distance from the axes extending through the respective sewing needles $\mathbf{50}_1$, $\mathbf{50}_2$. In an embodiment, rotation of sewing machine 22 involves rotation of the entire sewing machine 22. In another embodiment, the sewing head 48 may rotate about swivel axis "A" independent of the sewing machine 22. In another embodiment, the sewing needles $\mathbf{50}_1$, $\mathbf{50}_2$ and the sewing foot 52 may rotate about the swivel axis "A" independent of the sewing machine 22. Other variations are possible.

FIG. 2 further shows an end 56 of the borescope 29 coupled to image acquisition mechanism 28. The image acquisition mechanism 28 may be a solid-state camera or other image acquisition device. As shown, the end 56 of the borescope 29 is positioned in optical proximity to the sewing head 48 but out of the operator's line of sight of the general skin in-feed area to the sewing machine 22.

In an embodiment, the stitching system 20 may also include a proximity detector 60 or the like configured to detect needle strokes (i.e., to count stitches). Proximity detector 60 is thus configured and positioned to sense when needle $\mathbf{50}_1$ assumes an extended (down) position 61. The proximity detector 60 is configured to generate a stitch counter signal 62 which is routed to the electronic controller 32 for further processing as described below. The proximity detector 60 may comprise conventional components known in the art.

Basic Movements. FIGS. 3A-3C are diagrammatic, top views of the sewing machine 22, showing the basic control movements conducted in accordance with the real-time steering control of the instant disclosure. FIG. 3A shows the operator 21 in relation to the sewing machine 22 and the stationary support table 24. FIG. 3A also shows the display 54 in view of the operator 21. In FIG. 3B, the electronic controller 32 can effect a clockwise rotation $\mathbf{71}_{CW}$, while FIG. 3C shows a counter-clockwise rotation $\mathbf{71}_{CCW}$. Through the foregoing, the electronic controller 32 can correct for both left and right misalignment. With these basic movements in mind, a more detailed description of the steering control in relation to an automotive interior skin will now be set forth.

FIG. 3D is a diagrammatic top view of the sewing head 48, where the sewing needles $\mathbf{50}_1$, $\mathbf{50}_2$ and the sewing foot 52 are in a home position (i.e., not rotated away from a 0 degree position). The sewing foot 52 may be U-shaped such that it surrounds the sewing needles $\mathbf{50}_1$, $\mathbf{50}_2$. As shown for reference purposes, the automotive interior skin 64 may include a seam recess 66. The recess 66 imitates the intersection of two adjoining parts. As the name suggests, the recess 66 comprises a depression or seam in the surface of the skin 64.

The recess 66 serves as a reference for the operation of the stitching system 20. In particular, it is desirable for the recess 66 to be positioned in the center of the needles $\mathbf{50}_1$, $\mathbf{50}_2$ such that stitches from the needle $\mathbf{50}_1$ and stitches from the needle $\mathbf{50}_2$ are both offset on respective sides of and from the recess 66 at about the same predetermined distance (or within a predetermined tolerance of the desired offset from the recess). In FIG. 3D, the skin 64 is misaligned such that the recess 66 is offset to the left from the desired feed path (i.e., guide line shown in dashed line format). Accordingly, the recess 66 is not being fed through the dimensional center between the sewing needles $\mathbf{50}_1$, $\mathbf{50}_2$. The operator 21 may use the output from the display 54 for guidance in positioning the skin 64 so that the recess 66 is aligned with and centered between the sewing needles $\mathbf{50}_1$, $\mathbf{50}_2$.

The combination of image acquisition mechanism 28 and the positioning of the end 56 of borescope 29 results in the capture of image 30 having a certain field of view, which is designated 70 in the Figures. The field of view 70 is located near the sewing head 48 and on the in-feed side of the sewing head 48. In an embodiment, the captured image 30 (resulting from the field of view 70) is generally rectangular, and may have, for example only, dimensions of about six millimeters in "height" by twenty millimeters in "width", again, adjacent to the sewing needles $\mathbf{50}_1$, $\mathbf{50}_2$.

FIG. 3E is a diagrammatic top view of the sewing head 48, where the sewing needles $\mathbf{50}_1$, $\mathbf{50}_2$ and the sewing foot 52 are rotated clockwise by an amount determined by the electronic controller 32 (i.e., specifically, the control logic 42) to reduce and/or eliminate the degree of misalignment that was shown in FIG. 3D. In the illustrative embodiment, so long as the stitching system 20 determines that the recess 66 is misaligned or is otherwise offset from the desired in-feed path, the system 20 causes rotation of at least sewing needles $\mathbf{50}_1$, $\mathbf{50}_2$ and/or sewing foot 52 by an amount determined by control logic 42 (i.e., number of degrees) and in the determined direction 71 (i.e., clockwise or counter-clockwise). In an embodiment, the range of allowable rotation is plus or minus five degrees.

Figure 4:
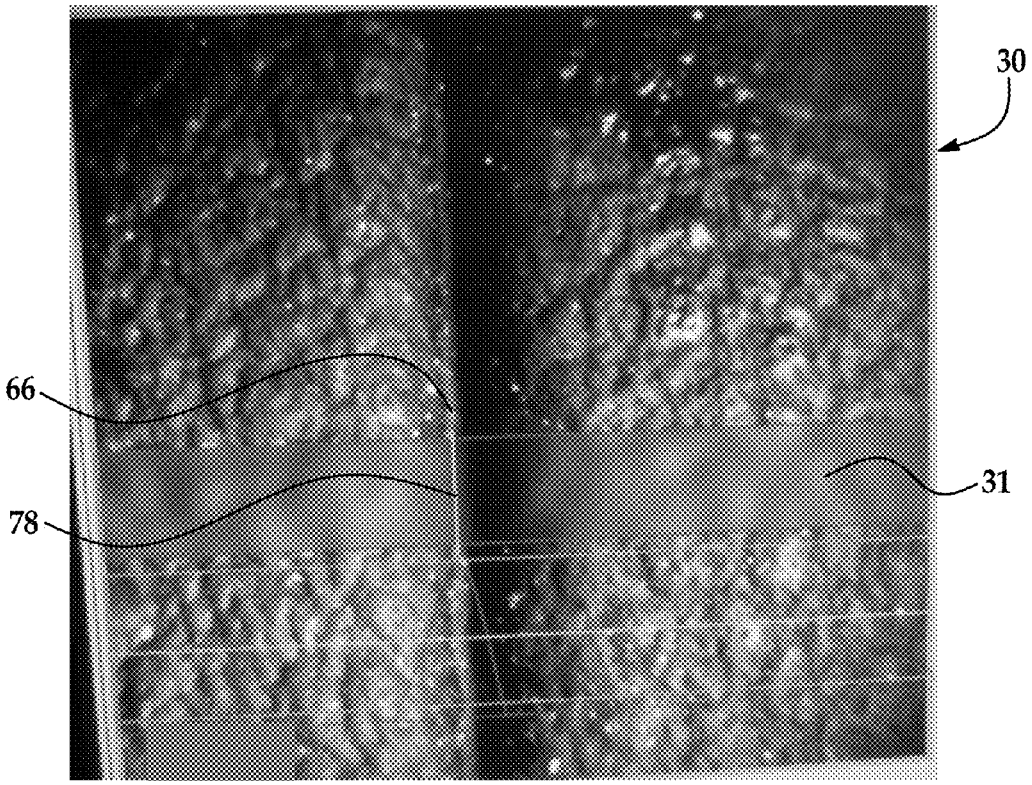
FIG. 4 is a diagrammatic view of an image of the skin material to be stitched, showing, in an embodiment, a blurred subsection.

FIG. 4 is a simplified view of an image 30. As noted above, the stitching system 20 includes the illumination mechanism 68, which is arranged to project light obliquely on the surface of the skin 64 so as to cast a shadow on the recess 66. The image processing logic 44 is configured to selectively blur a predetermined region of image 30, for example, blurred region 31, so as to improved recess detection. This selective blurring may be performed in additional areas of the image 30, or throughout the entire image 30. It should be understood that the skin 64 may have a grained texture that can give rise to a plurality of local light and shadow areas that may confuse or otherwise confound the image processing logic 44 that is looking to identify the location (in the image) of the shadow corresponding to the recess. The selective blurring deemphasizes the local light and shadow areas, thereby improving detection by reducing the detection problem to a global search for the shadow region corresponding to the recess. For example, line 78 has been detected in region 31 (of image 30) by the image processing logic 44 as corresponding to the seam recess 66.

Figure 5A:
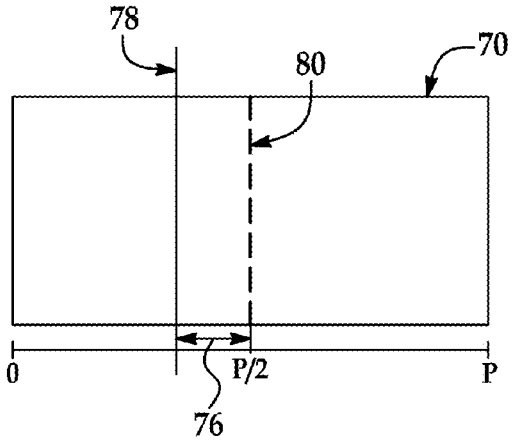
FIG. 5A is a top view illustrating a field of view of an image acquisition portion of FIG. 1A, where the actual location of the recess (solid line) is misaligned relative to a predetermined desired location (dashed line).

FIG. 5A is a diagrammatic top view of the image 30 corresponding to the field of view 70 in FIGS. 3D-3E. The image 30 includes a representation of an actual location 78 of recess 66 (solid line format) relative to a predetermined, known, desired location 80 (dashed line format). In the illustrative embodiment, the predetermined desired location 80 is located at a distance of P/2 where P is the length of the long side of the image 30. In other words, the desired location 80 is in the center of the image 30. The image processing logic 44 analyzes the image 30 to identify the actual location 78 of recess 66 (e.g., in a pixel space of the image 30). The image processing logic 44 is further configured to compare the actual location 78 with predetermined desired location 80 and then determine a difference 76 therebetween. The difference 76 corresponds to an error signal in a feedback control embodiment, and is indicative of a degree of misalignment. In an embodiment, the image processing logic 44 may also be configured to translate the difference 76 from a pixel space coordinate system (e.g., number of pixels) to a corresponding one-dimensional physical space coordinate system (e.g., millimeters). In other words, the image acquisition mechanism 28 (i.e., a location sensor) in combination with the image processing logic 44 may be configured to locate the recess 66 in one dimension, in one embodiment. Offsets, likewise, may therefore be determined in one dimension.

Figure 5B:
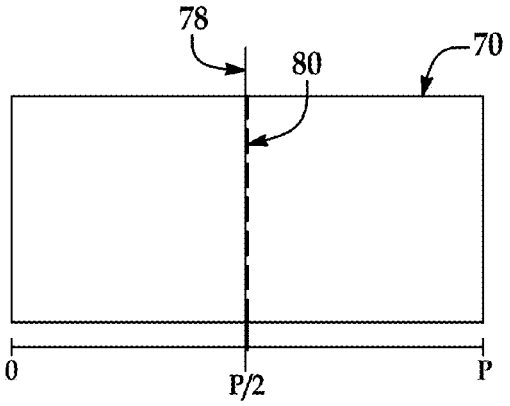
FIG. 5B is a top view illustrating the field of view of FIG. 5A, where the actual location of the recess has been aligned with the predetermined desired location of the recess.

FIG. 5B is a diagrammatic top view of the image 30, again showing the field of view 70. In FIG. 5B, the actual location 78 of recess 66 is now aligned with the predetermined desired location 80. In FIG. 5A, the determined difference 76 or error signal is substantially reduced to zero.

Figure 6:
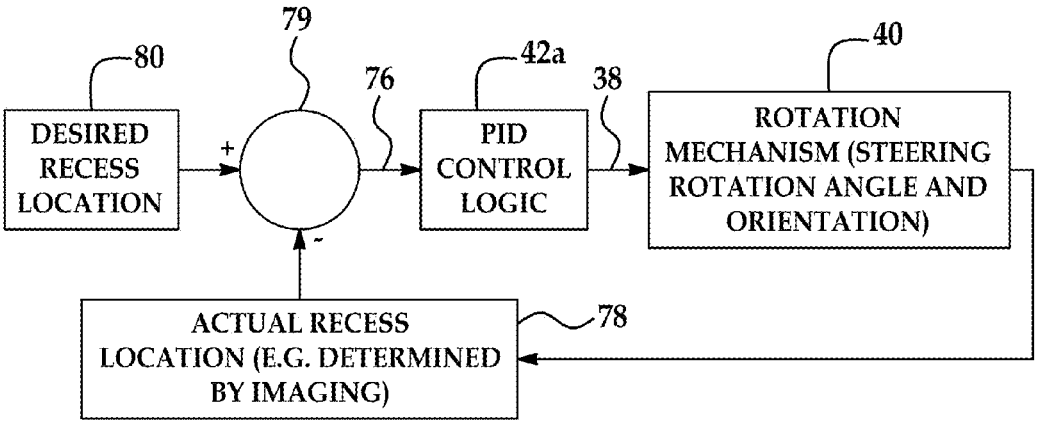
FIG. 6 is a block diagram a control logic portion of the controller of FIG. 1A.

FIG. 6 is a block diagram showing, in greater detail, the operational features of the control logic 42. While many feedback control approaches are known in the art, the illustrative embodiment uses a so-called proportional-integral-derivative (PID) feedback control strategy. In this regard, FIG. 6 shows a summer 79 that receives the actual location 78 of the recess 66 at an inverting input thereof, while also receiving the predetermined, desired location 80 at a non-inverting input thereof. The summer 79 produces an output designated 76, which corresponds to the determined difference 76 described in connection with FIGS. 5A-5B (i.e., in other words, an "error" signal 76). The error signal 76 is then provided to the control logic 42*a*, which operates in accordance with the above-mentioned PID control strategy to develop an output signal 38, which indicates generally the desired control action configured to reduce the error signal 76 to substantially zero.

In this embodiment, the output control action directed by the control logic 42*a* involves rotation of the sewing head 48 by a determined rotation angle and in a determined rotation orientation (i.e., clockwise or counter-clockwise). This command is encoded in the output signal 38. In an embodiment, the PID coefficients associated with the PID type control logic 42*a* may be determined empirically to accommodate a wide range of curvature radii and sewing speeds. For example, the coefficients can be adjusted so that (i) the stitching operation of the skin 64 can be accomplished in predetermined, desired timeframe, while (ii) the completing the stitching operation on the skin 64 within the specified dimensional tolerances.

With continued reference to FIG. 6, the rotation mechanism 40 receives output signal 38 and is configured to implement the commands encoded in the signal 38 by causing rotation of at least the sewing needles $\mathbf{50}_1$, $\mathbf{50}_2$ and/or the sewing foot 52 accordingly. Thereafter, the actual location 78 of the recess 66 is again determined by the image processing logic 44, and the control process implemented by the PID control logic 42*a* is repeated. In an embodiment, the actual location 78 is determined about one hundred times per second. It should be appreciated, however, that the loop time of the control may be adjusted to satisfy specified responsiveness criteria, as understood in the control arts.

Figure 7:
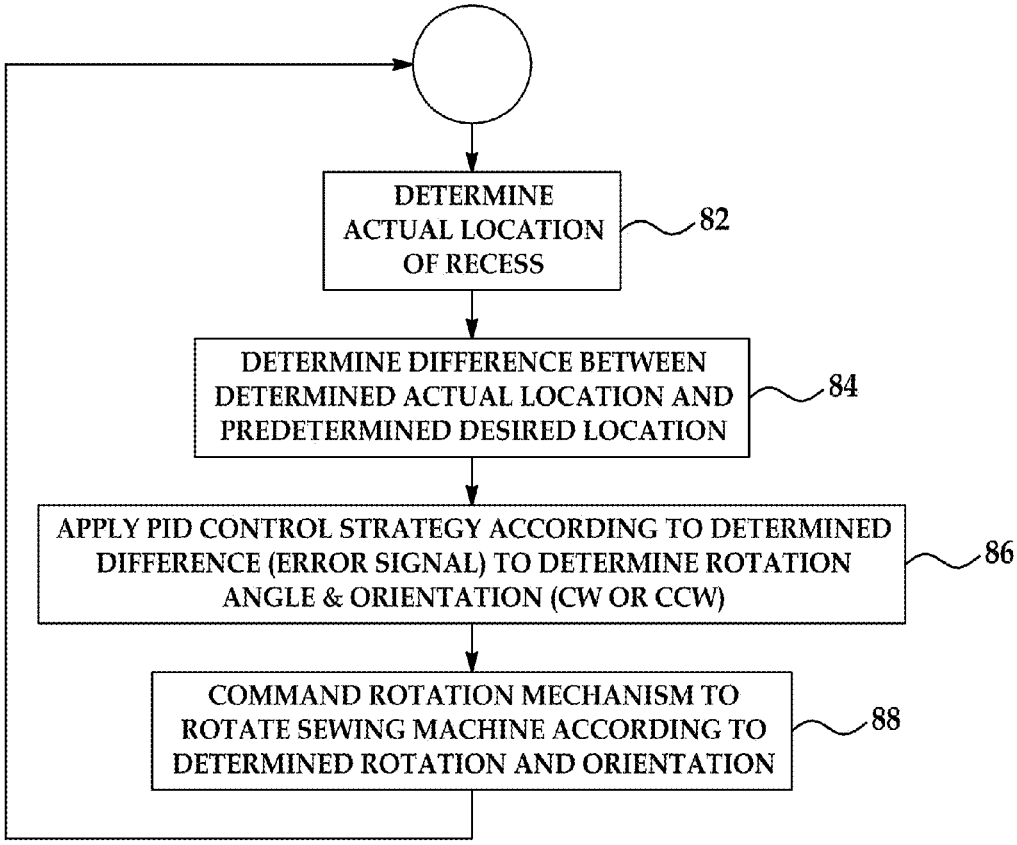
FIG. 7 is a flowchart showing an embodiment of method of decorative stitching using steering control.

FIG. 7 is a flowchart diagram showing a method of operating the stitching system 20 having real-time steering control. The steps of the method involve active steering assist of the sewing head so as to reduce the amount of misalignment of the recess 66 relative to predetermined desired location 80. The method begins in step 82.

In step 82, image processing logic 44 determines the actual location 78 of the recess 66. Step 82 may involve the sub-steps of (optionally) illuminating the skin 64 from an oblique angle to cast a shadow on the recess 66 in the area of the in-feed path, acquiring the image 30 of the in-feed path, blurring (optionally) the image 30 to facilitate detecting the shadow corresponding to the recess 66, and analyzing the (optionally blurred) image 30 to determine the actual location of the recess 66. One or more of these steps were described in greater detail above. The method proceeds to step 84.

In step 84, the image processing logic 44 determines the difference 76 between the actual location 78 and the predetermined desired location 80. As described above, this corresponds to an error signal in a feedback control strategy (FIG. 6). This step was described in greater detail above. The method proceeds to step 86.

In step 86, the control logic 42 (or the control logic 42*a*) determines a rotation angle (magnitude) and an orientation of rotation (i.e., CW or CCW), and produces data indicative of the commanded control action. The method proceeds to step 88.

In step 88, the electronic controller 32 generates and outputs the adjustment signal 38 in accordance with the particular implementing embodiment (e.g., servo-driven screw—FIGS. 14-15) based on the determined sewing machine rotation angle and orientation (step 86). The signal 38 commands the rotation mechanism 40 to rotate sewing machine 22 according to the determined rotation angle and orientation. The method returns to step 82, where the method is executed substantially continuously.

It should be understood that through the foregoing method, the stitching system 20 can provide steering assistance to the operator 21 in substantially real-time, in order to meet the predetermined, desired stitching tolerances that could not otherwise be consistently met when relying on human eyesight/reflexes alone. However, further embodiments described below in connection with FIGS. 8-12 are configured to extend the functionality of the stitching system 20.

Figure 8:
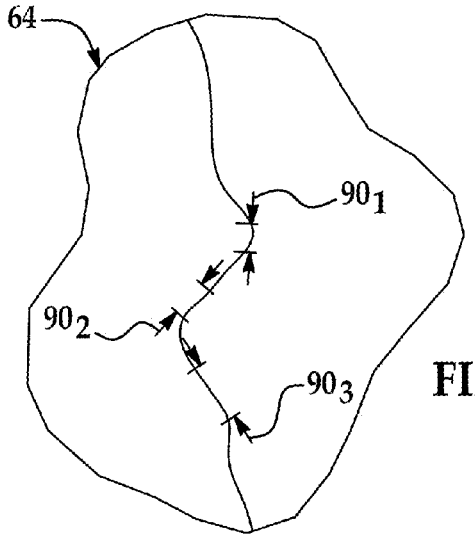
FIG. 8 is a top view of an automotive interior skin with a meandering seam recess divided into constituent segments.
Figures 9, 10:
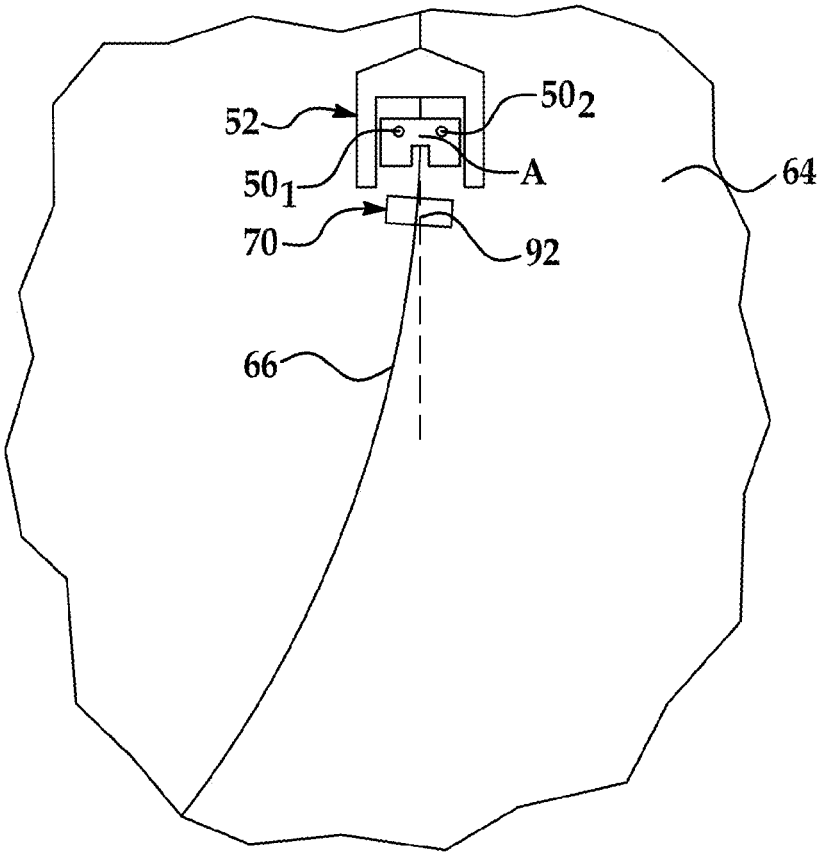
FIG. 9 is a table showing, in an embodiment, exemplary PID coefficients, defined on a per-segment basis, used by the control logic of FIG. 6.
FIG. 10 is a diagrammatic view of the system of FIG. 1A operating with respect to a large radius curvature recess.

FIGS. 8-9 show further illustrations to facilitate description of a further embodiment of the PID control logic 42*a*, where the control coefficients for each of the proportional (P), integral (I), and derivative (D) terms are tailored to the specific segment of the skin 64 over which the stitching system 20 is sewing, in order to improve sewing speed while continuing to meet dimensional tolerances.

FIG. 8 is a top plan view of the automotive interior skin 64 showing a meandering form of the recess 66. In one embodiment, the length of the recess 66 can be divided into a plurality of constituent segments, designated $\mathbf{90}_1$, $\mathbf{90}_2$, . . . , $\mathbf{90}_n$ where n is the total number of segments. In a production environment, the stitching system 20 can be expected to repeatedly stitch a plurality of workpieces (i.e., skin 64) that are substantially the same. Therefore, prior to this production, the recess 66 may be divided into a plurality of segments $\mathbf{90}_1$, $\mathbf{90}_2$, . . . , $\mathbf{90}_n$ as noted above. Each segment $\mathbf{90}_1$, $\mathbf{90}_2$, . . . , $\mathbf{90}_n$ may be unique in terms of length and the particular curve or curves included therein. For example, segment $\mathbf{90}_1$ is curved while segment $\mathbf{90}_2$ is generally straight. In addition, the radius of a curve in any particular segment may also vary. Also, the segments $\mathbf{90}_1$, $\mathbf{90}_2$, . . . , $\mathbf{90}_n$ may be different lengths. Thus, while segment $\mathbf{90}_2$ and segment $\mathbf{90}_3$ are both straight, segment $\mathbf{90}_3$ is longer in length. Depending on the shape and/or length of segment $\mathbf{90}_1$, $\mathbf{90}_2$, . . . , $\mathbf{90}_n$, the characteristics of the control action by the PID control logic 42*a* (e.g., how quickly and aggressively the rotation angle and orientation are adjusted in response to a certain error level) may benefit from adjustment that is unique to each segment $\mathbf{90}_1$, $\mathbf{90}_2$, . . . , $\mathbf{90}_n$.

FIG. 9 is a table showing respective PID coefficient sets for each one of the plurality of segments $\mathbf{90}_1$, $\mathbf{90}_2$, . . . , $\mathbf{90}_n$. The control logic 42*a* may include PID coefficients associated with corresponding control terms: a proportional coefficient, P; an integral coefficient, I; and a derivative coefficient, D. In calculating the desired control action (i.e., the rotation angle and orientation 71), the control logic 42*a* is configured, in an embodiment, to select a PID coefficient set from the table in accordance with the segment $90_1$, $90_2$, . . . , $90_n$ of the recess 66 currently being stitched.

In an embodiment, the control logic 42*a* may determine the segment number $90_1$, $90_2$, . . . , $90_n$ that the stitching system 20 is currently stitching by implementation of a stitch counter, which is discussed in detail below with respect to FIGS. 10-11. In another embodiment, the control logic 42*a* may determine the segment number $90_1$, $90_2$, . . . , $90_n$ by counting the number of stitches from a starting point. Through the foregoing, the tailored, piecewise PID control strategy can be implemented that optimizes both sewing speed as well as misalignment correction.

FIGS. 10-12 illustrate a further embodiment which involves counting stitches as a proxy for identifying what particular section of the length of the recess 66 that the stitching system 20 is currently stitching. This embodiment finds particular use in dealing with large curvature sections of the recess 66 where the information obtained via the image 30 may not be fully adequate to describe where, relative the seam recess 66, the sewing needles $50_1$, $50_2$ are in-fact stitching the skin 64. For example, as shown in FIG. 10, for large curvature sections, the skin 64 must be fed into the sewing head 48 somewhat from the side. Thus, even where there appears to be a misalignment or error 92, as viewed in the field of view 70, the continuation of the seam recess 66, by virtue of the curve, results in the recess 66 in-fact appearing nearly in the center between the needles $50_1$, $50_2$, as desired (i.e., in fact, no error as measured in the needle strike region). The embodiment described in connection with FIGS. 11-12 introduces a compensation factor to account for such situations as illustrated in FIG. 10.

FIG. 11 is a timing diagram of a stitch counter signal 62. As described above, in an embodiment, a proximity detector 60 is provided that is configured to sense when sewing needles $50_1$, $50_2$ have reached an extended (down) position 61 and, therefore, stitched through automotive interior skin 64. The proximity detector 60 may be sensitive to the presence or proximity of metal, such as provided by one of the needles $50_1$, $50_2$. The proximity detector 60 is configured to generate a stitch counter signal 62, which is provided to the electronic controller 32. As shown in FIG. 11, the signal 62 peaks at each occurrence of a needle extension, and such peaks (i.e., indicative of stitch numbers) are designated $62_1$, $62_2$, $62_3$, $62_4$, $62_5$, and $62_6$ in FIG. 11. The electronic controller 32 is configured to incorporate a stitch counter (not shown) responsive to signal 62, which stitch counter is in turn configured to count occurrences of such peaks $62_1$, $62_2$, $62_3$, $62_4$, $62_5$, and $62_6$, etc. and increment a running counter and output its current value to the control logic 42 (or logic 42*a*). As also shown in FIG. 11, an interval 100 between occurrences of adjacent peaks is indicative of a sewing speed. The sewing speed parameter will be used in a control action disable function described below.

FIG. 12 is a table showing a respective compensation amount $104_1$, $104_2$, $104_3$, . . . , $104_n$ as per a corresponding plurality of stitch numbers $102_1$, $102_2$, $102_3$, . . . , $102_n$. In an embodiment, the compensation amount is introduced into the control strategy at the front end thereof, namely, in calculating the difference signal or error signal.

Example. Assume the electronic controller 32 determines the difference (or "error") between the actual and desired recess locations in the physical space (i.e., millimeters). An offsetting compensation amount 104, also expressed in millimeters, may be introduced via reference to the table of FIG. 12 as a function of the current stitch count 102. For example, in FIG. 10, assume that the observed "error" as shown in the acquired image 30 is 1.38 mm, even though due to the curvature, the recess arrives in the needle strike region on "dead center". Further assume that FIG. 10 shows the relative progress of the skin 64 through the sewing machine 22 at a specific stitch count, for example, at a stitch count SC. The control logic 42 (or logic 42*a*) can look up the compensation amount for the current stitch count at stitch count SC, which compensation amount for stitch count SC in this example would be −1.38 mm. The determined difference (or "error"), after compensation, is now zero, and the control logic 42 (or logic 42*a*) will exercise no control action (rotation angle and orientation) to effect any adjustment. This is the intended and desired outcome, since the recess 66 is in fact arriving dead center in the needle strike region. The compensation amounts 104, on a per segment basis, for any particular skin 64, can be determined empirically. For example, a skin 64 can be stitched using the system 20, and the stitched lines can be measured relative to the seam recess 66 and any variation from dimensional tolerance limits can be recorded, and used to determine suitable compensation amounts. It should be understood that although the above example was described with respect to locations expressed in the physical domain (i.e., millimeters), the above seam measurement, and compensation amounts applied thereto as per the stitch number, can be performed in the pixel domain.

As an additional feature, the electronic controller 32 may be configured with a user interface to allow the operator to selectively reset the stitch counter so that the current stitch number 102 reads zero. In another embodiment, the current stitch counter may be reset when the sewing foot is raised to an "up" position (i.e., off the workpiece). This is useful whenever a new workpiece is inserted into the fixture for stitching purposes.

As another feature, there are situations where the operator 21 may wish to disable steering assistance, for example, when stitching particularly difficult or complex curves. While there may be a direct disable feature (e.g., OFF switch), in one embodiment, the stitching system 20 is configured to automatically determine when to de-activate or disable the steering control feature. This will be described below in connection with FIG. 13.

FIG. 13 is a flowchart showing a method of automatically de-activating or disabling steering control. The method involves a number of steps and begins in step 106.

In step 106, the electronic controller 32, via execution of the disable logic 46, monitors the sewing speed, which involves the sub-step of monitoring the stitch count signal 62 described above. If the disable logic 46 determines that the sewing speed is slow (i.e., it is likely that the operator is sewing through complex curves or geometries and would want steering assist OFF), then the steering control action described herein is disabled. Otherwise, the disable logic 46 allows the control logic 42 (or logic 42*a*) to continue to develop appropriate control action commands to correct any observed misalignment. The method proceeds to step 108.

In step 108, disable logic 46 determines a time interval 100 between each adjacent stitches. A time interval 100 between adjacent stitches is indicative of how fast (or slow) the operator is sewing. For example, an interval is shown in FIG. 11. The method proceeds to step 110.

In step 110, the disable logic 46 determines whether the operator 21 is sewing slowly. In an embodiment, the disable logic 46 may determine whether the sewing is sufficiently slow to warrant disabling control action automatically, by comparing the most recently determined time interval 100 with a predetermined time threshold. If the answer in step 110 is YES, then the method branches to step 112 where the control action is disabled (e.g., the disable logic 46 instructs the electronic controller 32, particularly the control logic thereof, to discontinue generating the adjustment signal, such that the sewing machine 22 will not be rotated and will remain in the home position). If the answer in step 112, however, is NO, then the method branches back to the monitoring step 106.

In one embodiment, the predetermined time threshold may be in the hundredths of a second. In another embodiment, however, the disable logic 46 assesses needle strikes/per time period rather than a time interval 100 such that if the number of stitches (stitch counts) per time period falls below a certain threshold (e.g., 5 stitches per second), then the sewing speed may be considered to be "slow" and the method then branches to step 112, otherwise the method will branch to monitoring step 106. Through the foregoing feature, the stitching system 20 can be configured to automatically disable the steering control without requiring a specific intervention by the operator 21.

Figure 14:
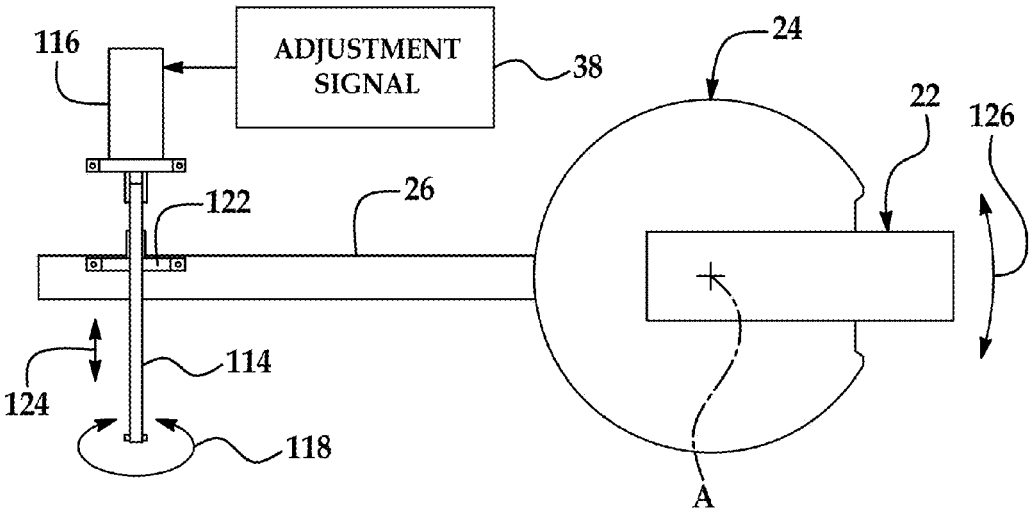
FIG. 14 is a diagrammatic, top view of an embodiment of a rotation mechanism.

FIG. 14 is a diagrammatic, top view of an embodiment of the rotation mechanism 40. The rotation mechanism 40 may include a ball screw 114 coupled to and driven by a servo drive 116, an internally-threaded nut 122 or the like, and lever arm 26 rigidly coupled to nut 122. The servo drive 116 receives the adjustment signal 38 from the controller 32 and responds to the signal 38 by effecting a corresponding rotation (and direction) of screw 114 needed to achieve the commanded sewing machine rotation. For example, servo drive 116 may rotate ball screw 114 in direction 118 (clockwise or counter-clockwise) in order to achieve either an advancement or a retraction of nut 122. Nut 122, in turn, contains internal threads such that when ball screw 114 rotates, nut 122 translates linearly in direction 124. Linear movement 124 of nut 122 in turn causes a corresponding movement to be applied to lever arm 26. Servo drive 116 is generally fixed. However, because lever arm 26 rotates about swivel axis A and thus causes a desired rotation 126 of the sewing machine 22, the rotation mechanism 40 (i.e., one or more of the servo drive 116, ball screw 114, or nut 122) accommodates for the small rotary movement of lever arm 26.

Figure 15:
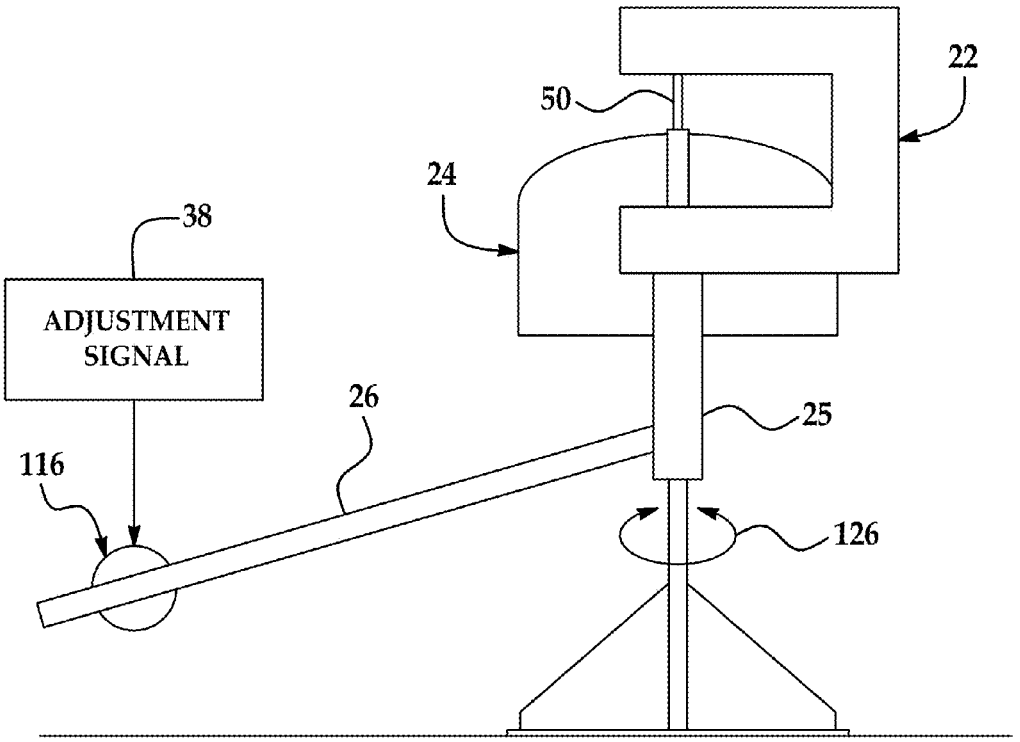
FIG. 15 is a diagrammatic, front view of the rotation mechanism of FIG. 14.

FIG. 15 is a diagrammatic, front view of the rotation mechanism 40 of FIG. 14. The sewing machine 22 is physically coupled to the pivoting base 25 such that rotation in direction 126 of pivoting base 25 will result in a like rotation 126 of the sewing machine 22. One of ordinary skill in the art will recognize that other rotation mechanisms may be used. For example, servo drive 116 or the like may be coupled directly with the pivoting base 25.

Figure 16:
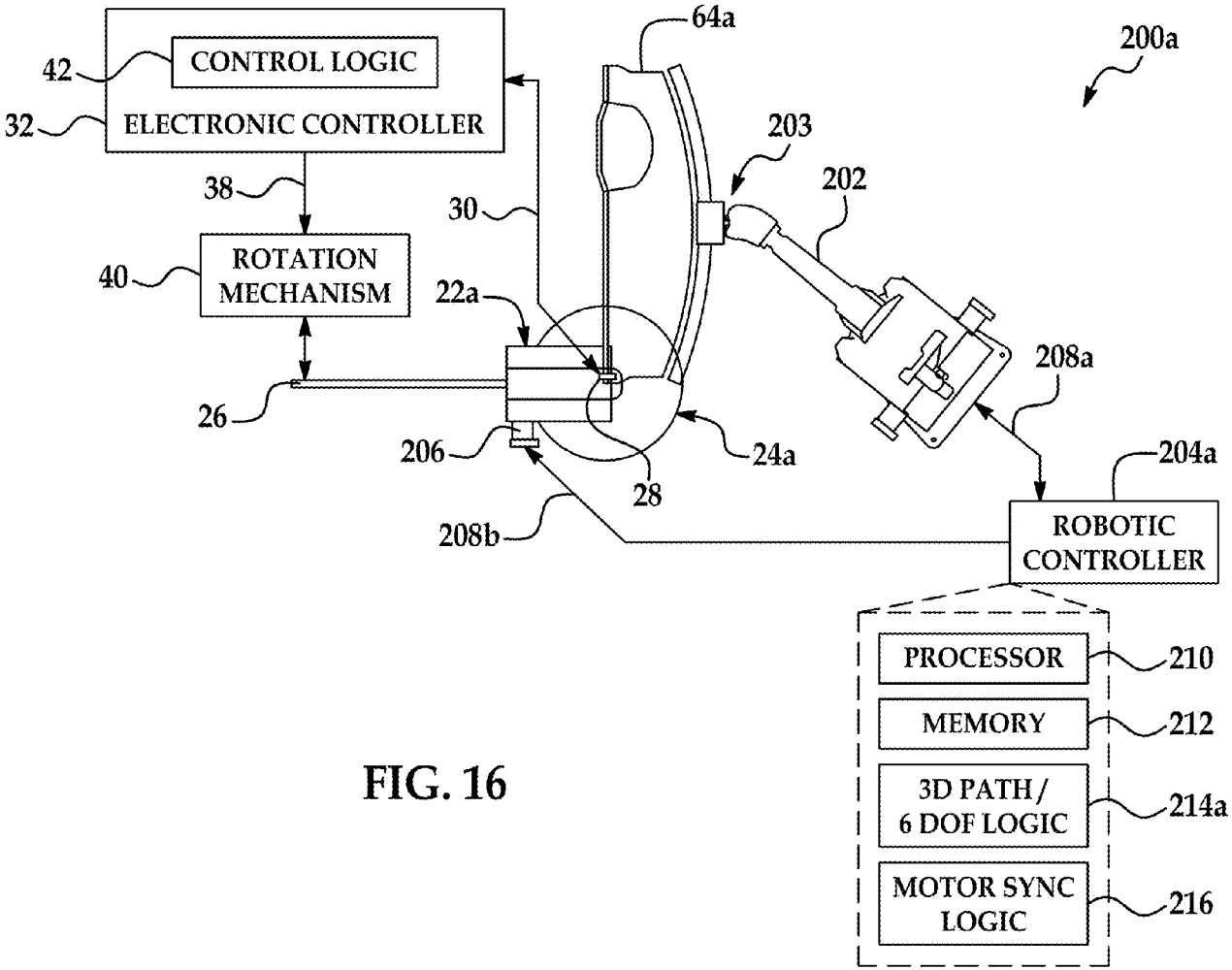
FIG. 16 is a diagrammatic and block diagram view of a further embodiment where a robot replaces an operator in feeding the work-piece into the sewing machine.

FIG. 16 is a diagrammatic and block diagram view of a further embodiment of a stitching system, designated stitching system 200*a*. The system 200*a* is similar to the stitching system 20, but incorporates a robot 202 controlled by a robotic controller 204*a*, which nominally takes the place of the operator 21, as well as a modified sewing machine 22*a*, which include a drive motor 206 that is also controlled by the robotic controller 204*a*.

The stitching system 200*a* is configured stitch through an automotive interior skin 64*a* of the type having a molded seam that defines a recess path thereon. The stitching system 200*a* includes a sewing machine 22*a* disposed proximate a support table 24*a*, a sensor such as an image acquisition mechanism 20 configured to capture an image 30 near or proximate the in-feed side of the sewing machine 22*a*, an electronic controller 32, a rotation mechanism 40 responsive to an adjustment signal 38, a robot 202 having an end-effector 203, and a robotic controller 204*a*.

The sewing machine 22*a* may be similar to sewing machine 22 described above, and thus includes a sewing head 48 with a sewing foot 52 and a sewing needle receiver 33 for receiving a sewing needle. The sewing machine 22*a* is rotatably coupled to a pivoting base 25 wherein rotation of the sewing machine 22*a* also rotates at least the sewing head 48 and/or the sewing foot 52 about a swivel axis. The sewing machine 22*a* include a motor 206 whose operation is configured to actuate strikes of the sewing needle receiver 33 (with needle 50) based on a motor control signal 208*b*.

The image acquisition mechanism 28 is disposed in visual proximity to the sewing head 48 and is configured to produce an output (e.g., the image 30) indicative of an actual location of the recess in the skin 64*a*.

The electronic controller 32 may be the same (or similar) electronic controller 32 described above, and thus includes an electronic processor 34, memory 36, and be configured to determine, based on the output of the image acquisition mechanism 28, a difference between said actual location of the recess and a predetermined, desired location of the recess. The controller 32 is thus also further configured to determine a rotation angle and rotation orientation (CW or CCW) for the sewing machine 22*a* that is configured to reduce a magnitude of the actual-to-desired seam recess location. The controller 32 may be further configured to produce the adjustment signal 38 indicative of the determined rotation angle and orientation. Moreover, the controller 32 may include the control logic 42 (or control logic 42*a*), and the image processing logic 44 as described above (although not shown in FIG. 16). In a certain embodiment, the disable logic 46 of the stitching system 20 is not carried forward for use in stitching system 200*a*, since the disable logic 46 assumes the availability of the operator 21 to manually sew the workpiece when the steering control has been disabled, which is not necessarily present in the robotic embodiment of FIG. 16. In other embodiments, however, a variation of the disable logic 46 may be provided, which disables the steering control logic 42, but in which case, the robotic controller 204*a* moves the workpiece at an appropriately slow speed (but without steering control). Other variations are possible.

The rotation mechanism 40 may also be the same (or similar) as that described above, and thus may be responsive to the adjustment signal 38, which rotation mechanism 40 is configured to rotate the sewing machine 22*a* in the determined rotation angle and orientation.

The robot 202 may be of the type having an end-effector 203, which can be moved in three-dimensions and which movement is characterized by six degrees of freedom (i.e., X, Y, Z axes, in addition to roll, pitch, and yaw movements). The end-effector 203 is configured to be coupled to the skin 64*a*, as shown.

The robotic controller 204*a* is electrically coupled to the robot 202 and is configured to control movements of the robot 202, and in particular, the movements of the end-effector 203, through the generation of a robot control signal 208*a*. The robotic controller 204*a* may include one or more processors 210, memory 212, three-dimensional (using 6 DOF) path logic 214*a*, and sewing motor coordination (synchronization) logic 216. The path logic 214*a*, when executed on the processor 210 of the robotic controller 204*a*, controls the movement of the robot end-effector 203 through an end-effector path such that the seam recess path of the skin 64*a* is moved through (or travels through) the sewing head 48 for stitching about the seam recess. The path that the end-effector takes can be hand programmed, for example, a technician or the like can jog the robot (end-effector) and skin a little at a time (e.g., millimeter by millimeter) so that the seam recess appears between the needles. The movement that the end-effector 203 takes (as directed by the technician) can be recorded in the path logic 214*a* for use during operation of the stitching system 200*a*. Note, that to the extent that the end-effector path does not completely result in the seam recess appearing within tolerance between the needles of the sewing head, the real-time steering control described herein is operative to correct for any run-time variances—keeping the final stitch lines within tolerance.

It should be understood that the sewing head 48 is positioned in a fixed location in a three-dimensional coordinate system, while the end-effector 203 travels along an end-effector path, which is also defined in the three-dimensional coordinate system. The path logic 214*a*, when executed, is configured to cause the end-effector 203 to move along the end-effector path, which is not necessarily the same as the seam recess path. For example, for tight radius curves, the skin 64*a* may be significantly rotated so that the curvature of the seam recess will arrive at the sewing head in the desired location. In this regard, the path logic 214*a* can make use of all of the six degrees of freedom available with the movements of the robot 202.

In addition, the motor synchronization logic 216, stored in memory 212 for execution by processor 210, is configured to generate the motor control signal 208*b*, and is operable to coordinate the frequency of actuation of the needle strikes of the sewing machine 22*a* with the travel speed of the seam recess as it passes through the sewing head 48. In other words, the sewing speed is coordinated with the travel speed of the skin 64*a* through the stitching area.

The operation of the stitching system 200*a* is similar to that of the stitching system 20, in that the robot 202 moves the skin 64*a* generally along the desired path to accomplish stitching, while the steering control provided by the electronic controller 32 and the rotation mechanism 40, as already described hereinabove, can make any necessary fine adjustments so that in-tolerance stitching can in-fact be achieved. In various embodiments, the features of the stitching system 20 described above can be used in connection with the stitching system 200*a*.

Figure 17:
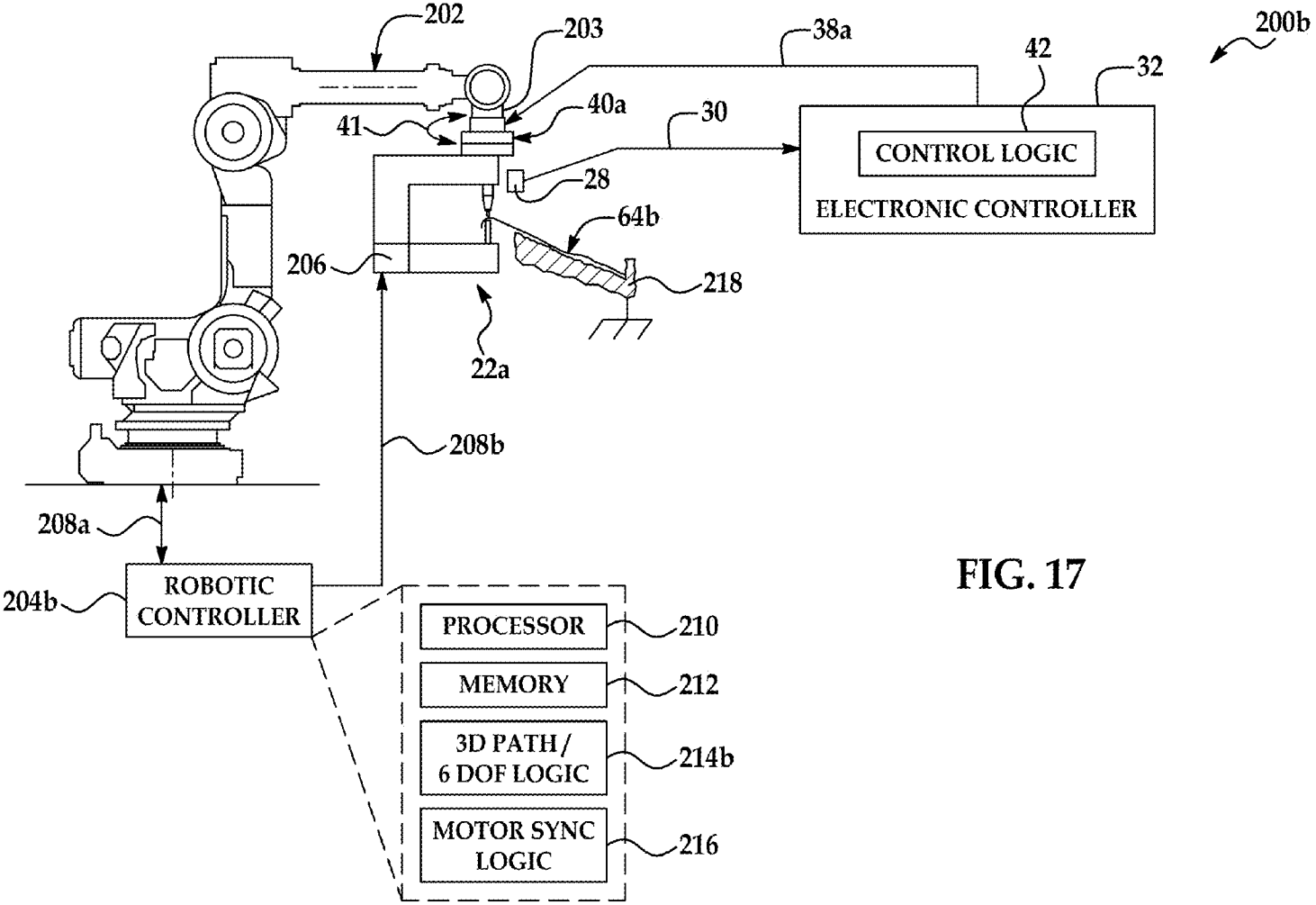
FIG. 17 is a diagrammatic and block diagram view of a still further embodiment where a robot is configured to move the sewing machine across the work-piece.

FIG. 17 is a diagrammatic and block diagram view a still further embodiment of a stitching system, designated stitching system 200*b*. Unless otherwise described herein, the stitching system 200*b* is the same or similar to the stitching system 200*a*. Accordingly, the detailed description herein will focus on the pertinent differences. The system 200*b* is similar to the stitching system 200*a*, but configures the robot 202 (controlled by a robotic controller 204*b*) to move the sewing machine 22*a* relative to a fixed automotive interior skin 64*b*, which can be received within a fixture or jig 218. Steering control is provided by a servo motor or the like (designated rotation mechanism 40*a*) that can rotate (direction 41) the sewing machine 22*a*. The rotation mechanism 40*a* is disposed between the end-effector 203 and the sewing machine 22*a*.

The robotic controller 204*b* is configured, through the path logic 214*b*, to generate robot control signal 208*a* that is operable to cause movement of the end-effector 203 through an end-effector path (not shown) that closely corresponds to, but is offset from, the seam recess path defined in the automotive skin 64*b*. As a result, the sewing head 48 of the sewing machine 22*a* is moved to follow, generally, along the seam recess path of the skin 64*b*. The electronic controller 32 is configured to provide steering control in substantially the same fashion as described above in connection with stitching systems 20, and 200*a*; however, in stitching system 200*b*, the electronic controller 32 generates the adjustment signal 38*a* (indicative of a commanded sewing head rotation angle and orientation) suitable for actuating the servo motor 40*a*, which is mounted in between the robot's wrist plate and the sewing machine 22*a*. As with stitching system 200*a*, the robotic controller 204*b* of the stitching system 200*b* controls the sewing motor 206 (via motor control signal 208*b*) so as to coordinate the sewing speed with the travel speed of the sewing head along the seam recess path. It should be understood that variations are possible.

It should be further understood that an article of manufacture in accordance with this disclosure includes a computer-readable storage medium having a computer program encoded thereon for implementing the stitching operations, which include the real-time steering control, all as described herein. The computer program includes code to perform one or more of the methods disclosed herein.

While one or more particular embodiments have been shown and described, it will be understood by those of skill in the art that various changes and modifications can be made without departing from the spirit and scope of the present teachings. It should be further understood that while embodiments entail decorative stitching, this decorative purpose is not required. Other embodiments consistent with the scope of the invention may involve actual, functional stitching (i.e., join 2 or more pieces together), rather than for only decorative purposes. While one embodiment involves stitching automotive interior components with a recess, the invention is not so limited and can be used for other components having a recess.

What is claimed is:

1. A stitching system configured to stitch through an automotive interior skin with a molded seam recess defining a recess path comprising:

(a) a sewing machine disposed proximate a support table and including a sewing head with a sewing foot and a sewing needle receiver for receiving a needle, the sewing machine being rotatably coupled to a pivoting base wherein rotation of the sewing machine rotates at least the sewing head and the sewing foot about a swivel axis;

(b) a sensor in sensing proximity to the sewing head and configured to produce an output indicative of an actual location of the recess in the skin;

(c) an electronic controller including an electronic processor configured to determine a difference between the actual location of the recess and a predetermined, desired location of the recess based on the sensor output, the controller being further configured to determine a rotation angle relative to the seam recess and orientation relative to the seam recess for the sewing machine that is configured to reduce a magnitude of the difference, the controller being further configured to produce an adjustment signal indicative of the determined rotation angle and orientation;

(d) a rotation mechanism responsive to the adjustment signal configured to rotate the sewing machine in the determined rotation orientation to the determined rotation angle;

(e) a robot having an end-effector configured for movement in multiple degrees of freedom, the end-effector configured for coupling to the automotive interior skin; and (f) a robotic controller coupled to the robot for controlling movement of the end-effector, the robotic controller being configured to move the end-effector through an end-effector path such that the recess path travels past the sewing head.

2. The system of claim 1 wherein the sewing machine includes a motor configured to actuate strikes of the sewing needle receiver in accordance with a motor control signal, the robotic controller including motor synchronization logic stored in a robotic controller memory for execution by a robotic controller processor and configured to generate the motor control signal so as to coordinate the frequency of actuation of the needle strikes with a travel speed of seam recess path as it passes by the sewing head.

3. The system of claim 1 wherein the end-effector path is defined in a three-dimensional coordinate system and the sewing head is defined in the three-dimensional coordinate system, the robotic controller being configured to control movement of the end-effector in six degrees of freedom (6 DOF), the robotic controller being configured with path logic configured to control movement of the end-effector along the end-effector path such that the recess path travels past the sewing head.

4. The system of claim 1 wherein the sewing needle is a first sewing needle and the needle axis is a first needle axis, the sewing machine head further including a second sewing needle receiver for a second needle having a second needle axis associated therewith, the swivel axis being generally parallel to the first and second needle axes, the swivel axis being offset from the first and second needle axes by a predetermined distance.

5. The system of claim 1 wherein the sensor comprises an image acquisition mechanism configured to acquire an image in a predetermined region proximate the sewing head.

6. The system of claim 1 wherein the electronic controller comprises: control logic stored in memory and configured for execution by the electronic processor, the control logic being configured to determine the rotation angle and the rotation orientation in accordance with a proportional-integral-differential (PID) control strategy, the PID control strategy being responsive to at least the determined difference.

7. The system of claim 5 wherein the sensor comprises an image acquisition mechanism configured to acquire an image of a predetermined region proximate the sewing head, the electronic controller further comprising: image processing logic stored in memory configured for execution by the electronic processor configured to analyze the image so as to (i) identify a first location of the recess in a pixel space of the image; (ii) specify a second location in the pixel space; and (iii) determine the difference by assessing the determined first and second locations.

8. The system of claim 7 wherein the image processing logic is further configured to translate the difference in pixel space to a corresponding difference in an at least one dimensional physical space.

9. The system of claim 8 wherein the recess of the skin includes at least one segment, the PID control strategy has associated therewith at least a first set of coefficients respectively associated with proportional, integral and differential terms of the PID control strategy, the first set of coefficients being used by the PID control strategy to determine the rotation angle and the rotation orientation over the first segment.

10. The system of claim 9 wherein the recess further includes a second segment different than the first segment, the PID control strategy having associated therewith a second set of coefficients associated with proportional, integral and differential terms of the PID control strategy different from the first set of coefficients, the second set of coefficients being used by the PID control strategy to determine the rotation angle and the rotation orientation over the second segment.

11. The system of claim 6 further including a proximity detector configured to sense a stitch by the sewing needle and generate a stitch counter signal in response thereto, the control logic being further configured to maintain the current stitch count along a feed path defined by the recess of the skin; and determine the rotation angle and the rotation orientation as a function of the current stitch count.

12. The system of claim 11 wherein the control logic further includes a compensation data structure including stitch number-versus-compensation value data.

13. The system of claim 1 wherein the rotation mechanism includes a servo drive responsive to the adjustment signal.

14. The system of claim 1 further comprising an illumination source disposed with respect to the sewing machine so as to project oblique illumination on the automotive interior skin to cast a shadow on the seam.

15. A stitching system configured to stitch through an automotive interior skin with a molded seam recess defining a recess path, comprising:

(a) a sewing machine including a sewing head with a sewing foot and a sewing needle receiver for receiving a needle, the sewing machine being rotatably coupled to a rotation mechanism responsive to an adjustment signal configured to rotate the sewing machine wherein rotation of the sewing machine rotates at least the sewing head and the sewing foot about a swivel axis;

(b) a sensor in sensing proximity to the sewing head and configured to produce an output indicative of an actual location of the recess in the skin;

(c) a robot having an end-effector configured for movement with multiple degrees of freedom, the end-effector being coupled to the rotation mechanism;

(d) a robotic controller coupled to the robot for controlling movement of the end-effector, the robotic controller being configured to move the end-effector through an end-effector path corresponding to but offset from the recess path such that the the sewing head travels along the recess path; and (e) an electronic controller, including an electronic processor, configured to determine, based on the sensor output, a difference between the actual location of the recess and a predetermined, desired location of the recess, the electronic controller being further configured to determine a rotation angle relative to the seam recess and orientation relative to the seam recess for the sewing machine that is configured to reduce a magnitude of the difference, the controller being further configured to produce the adjustment signal indicative of the determined rotation angle and orientation.

16. The system of claim 15 wherein the sewing machine includes a motor configured to actuate strikes of the sewing needle receiver in accordance with a motor control signal, the robotic controller including motor synchronization logic stored in a robotic controller memory for execution by a robotic controller processor and configured to generate the motor control signal so as to coordinate the frequency of actuation of the needle strikes with a travel speed of the end-effector along the end-effector path.

17. The system of claim 15 wherein the rotation mechanism has a driving axis about which the sewing machine is rotated, the swivel axis being offset from the driving axis.

18. The system of claim 15 further including a fixture in which the automotive interior skin is disposed.

19. The system of claim 15 wherein the sewing needle is a first sewing needle and the needle axis is a first needle axis, the sewing machine head further including a second sewing needle receiver for a second needle having a second needle axis associated therewith, the swivel axis being generally parallel to the first and second needle axes, the swivel axis being offset from the first and second needle axes by a predetermined distance.

20. The system of claim 15 wherein the sensor comprises an image acquisition mechanism configured to acquire an image in a predetermined region proximate the sewing head.

21. The system of claim 15 wherein the electronic controller comprises: control logic stored in memory and configured for execution by the electronic processor, the control logic being configured to determine the rotation angle and the rotation orientation in accordance with a proportional-integral-differential (PID) control strategy, the PID control strategy being responsive to at least the determined difference.

22. The system of claim 20 wherein the sensor comprises an image acquisition mechanism configured to acquire an image of a predetermined region proximate the sewing head, the electronic controller further comprising: image processing logic stored in memory configured for execution by the electronic processor configured to analyze the image so as to (i) identify a first location of the recess in a pixel space of the image; (ii) specify a second location in the pixel space; and (iii) determine the difference by assessing the determined first and second locations.

23. The system of claim 22 wherein the image processing logic is further configured to translate the difference in pixel space to a corresponding difference in an at least one dimensional physical space.

24. The system of claim 23 wherein the recess of the skin includes at least one segment, the PID control strategy has associated therewith at least a first set of coefficients respectively associated with proportional, integral and differential terms of the PID control strategy, the first set of coefficients being used by the PID control strategy to determine the rotation angle and the rotation orientation over the first segment.

25. The system of claim 24 wherein the recess further includes a second segment different than the first segment, the PID control strategy having associated therewith a second set of coefficients associated with proportional, integral and differential terms of the PID control strategy different from the first set of coefficients, the second set of coefficients being used by the PID control strategy to determine the rotation angle and the rotation orientation over the second segment.

26. The system of claim 21 further including a proximity detector configured to sense a stitch by the sewing needle and generate a stitch counter signal in response thereto, the control logic being further configured to skin; and maintain the current stitch count along a feed path defined by the recess of the determine the rotation angle and the rotation orientation as a function of the current stitch count.

27. The system of claim 26 wherein the control logic further includes a compensation data structure including stitch number-versus-compensation value data.

28. The system of claim 15 wherein the rotation mechanism includes a servo drive responsive to the adjustment signal.

29. The system of claim 15 further comprising an illumination source disposed with respect to the sewing machine so as to project oblique illumination on the automotive interior skin to cast a shadow on the seam.

30. A stitching system configured to stitch an automotive interior skin along a recess comprising:

(a) a sewing machine comprising a head and a foot and configured to rotate at least the head and the foot about an axis;

(b) a sensor configured to indicate location of the recess in the skin;

(c) a controller configured (1) to determine a difference between an indicated location of the recess and an intended location of the recess; and (2) to determine a rotation angle relative to the recess and orientation relative to the recess to reduce the difference; and (3) to produce an adjustment signal indicative of the difference to reduce the difference;

(d) a mechanism responsive to the adjustment signal configured to orient the head of the sewing machine relative to the skin by the rotation angle and/or orientation for the intended location of the recess to reduce the difference.

* * * * *